US011100864B2

(12) United States Patent
Lee et al.

(10) Patent No.: US 11,100,864 B2
(45) Date of Patent: Aug. 24, 2021

(54) DATA DRIVER AND DISPLAY DRIVING CIRCUIT INCLUDING THE SAME

(71) Applicant: SAMSUNG ELECTRONICS CO., LTD., Suwon-si (KR)

(72) Inventors: Hajun Lee, Suwon-si (KR); Jeongah Ahn, Suwon-si (KR); Jiyong Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/802,836

(22) Filed: Feb. 27, 2020

(65) Prior Publication Data

US 2020/0357338 A1 Nov. 12, 2020

(30) Foreign Application Priority Data

May 8, 2019 (KR) ..... 10-2019-0053906

(51) Int. Cl.
*G09G 3/3258* (2016.01)

(52) U.S. Cl.
CPC ... *G09G 3/3258* (2013.01); *G09G 2310/0294* (2013.01)

(58) Field of Classification Search
CPC ..... G09G 3/3258; G09G 2310/0294; G09G 2320/045; G09G 3/3233; G09G 3/325
See application file for complete search history.

(56) References Cited

U.S. PATENT DOCUMENTS

| | | | | |
|---|---|---|---|---|
| 9,311,858 | B2 | 4/2016 | Cho et al. | |
| 9,530,356 | B2 | 12/2016 | Min et al. | |
| 9,542,873 | B2 | 1/2017 | Yu et al. | |
| 9,870,737 | B2 | 1/2018 | Lee et al. | |
| 10,032,409 | B1 | 7/2018 | Wu | |
| 10,089,928 | B2 | 10/2018 | Yoo et al. | |
| 10,497,308 | B1 * | 12/2019 | Tseng | G09G 3/3233 |
| 2011/0102410 | A1 * | 5/2011 | Cho | G09G 3/3291 345/212 |

(Continued)

FOREIGN PATENT DOCUMENTS

| | | | |
|---|---|---|---|
| KR | 10-1475085 | B1 | 12/2014 |
| KR | 10-2017-0080776 | A | 7/2017 |

(Continued)

*Primary Examiner* — Ibrahim A Khan
(74) *Attorney, Agent, or Firm* — Sughrue Mion, PLLC

(57) ABSTRACT

Provided are a data driver and a display driving circuit including the data driver. A data driver configured to drive a display panel including a plurality of subpixels connected to a plurality of sensing lines includes: a plurality of sample-and-hold circuits configured to perform a sampling operation on a plurality of sensing signals received via the plurality of sensing lines; a switching block configured to provide a first sensing signal among the plurality of sensing signals to a first sample-and-hold circuit in a first sensing period, and in a second sensing period, provide the first sensing signal to a second sample-and-hold circuit not being adjacent to the first sample-and-hold circuit in a second sensing period; and a converting circuit configured to generate a plurality of sensing values by amplifying and analog-to-digital converting on outputs of the plurality of sample-and-hold circuits.

20 Claims, 15 Drawing Sheets

(56) References Cited

U.S. PATENT DOCUMENTS

| | | | | |
|---|---|---|---|---|
| 2015/0091888 | A1* | 4/2015 | Min | G09G 3/3291 345/212 |
| 2016/0071445 | A1* | 3/2016 | Kim | G09G 3/006 345/212 |
| 2017/0004776 | A1* | 1/2017 | Park | G09G 3/3208 |
| 2017/0038898 | A1* | 2/2017 | Kim | G09G 3/3233 |
| 2017/0154573 | A1* | 6/2017 | Woo | G09G 3/3291 |
| 2017/0168648 | A1* | 6/2017 | Takahashi | G06F 3/0445 |
| 2018/0137819 | A1* | 5/2018 | An | G09G 3/3233 |
| 2018/0174522 | A1* | 6/2018 | Lee | G09G 3/3258 |
| 2018/0190207 | A1* | 7/2018 | Hwang | G09G 3/3233 |
| 2019/0012948 | A1* | 1/2019 | Ohara | G09G 3/3233 |

FOREIGN PATENT DOCUMENTS

| | | | |
|---|---|---|---|
| KR | 10-2018-0015571 | A | 2/2018 |
| KR | 10-2018-0113696 | A | 10/2018 |

* cited by examiner

DATA DRIVER AND DISPLAY DRIVING CIRCUIT INCLUDING THE SAME

CROSS-REFERENCE TO THE RELATED APPLICATION(S)

This application claims priority from Korean Patent Application No. 10-2019-0053906, filed on May 8, 2019, in the Korean Intellectual Property Office, the disclosure of which is incorporated herein in its entirety by reference.

BACKGROUND

1. Field

The example embodiments of the disclosure relate to a semiconductor device, and more particularly, to a data driver configured to drive a display panel to display an image thereon, and a display driving circuit including the data driver.

2. Description of the Related Art

A display device includes a display panel and a display drive circuit configured to drive the display panel to display an image. The display drive circuit may drive the display panel by receiving image data from the outside and applying an image signal corresponding to the received image data to a data line of the display panel. Recently, usage of an organic light emitting diode (OLED) display panel in which each of a plurality of subpixels of a pixel array has an OLED is increasing.

In the OLED display panel, when electrical characteristics such as a threshold voltage and mobility of a driving transistor included in a subpixel are not uniform among subpixels and are changed by deterioration of the subpixels, quality of an image displayed on the OLED display panel may be reduced. Thus, there is a need for a method of detecting the electrical characteristics of the sub-pixels and compensating subpixel data to be provided to each subpixel by using compensation values that are determined based on the detected electrical characteristics.

SUMMARY

One or more example embodiments according to the disclosure provide a data driver capable of compensating for output deviation(s) between a plurality of sample-and-hold circuits for sampling sensing signals received from a display panel, and a display driving circuit including the data driver.

According to an aspect of the disclosure, there is provided a data driver configured to drive a display panel, the display panel including a plurality of sensing lines and a plurality of subpixels connected to the plurality of sensing lines, the data driver including: a plurality of sample-and-hold circuits configured to perform a sampling operation on a plurality of sensing signals respectively received via the plurality of sensing lines; a switching block configured to provide the plurality of sensing signals to the plurality of sample-and-hold circuits, the switching block being further configured to, in a first sensing period, provide a first sensing signal among the plurality of sensing signals to a first sample-and-hold circuit among the plurality of sample-and-hold circuits, and in a second sensing period, provide the first sensing signal to a second sample-and-hold circuit not being adjacent to the first sample-and-hold circuit among the plurality of sample-and-hold circuits; and a converting circuit configured to generate a plurality of sensing values by amplifying and performing an analog-to-digital conversion on an output of each of the plurality of sample-and-hold circuits.

According to another aspect of the disclosure, there is provided a display driving circuit including: a plurality of sample-and-hold circuits configured to receive a plurality of sensing signals respectively via a plurality of sensing lines of a display panel; a switching block configured to, in a first sensing period, perform a first one-to-one connection of the plurality of sensing lines to the plurality of sample-and-hold circuits in a first order, and, in a second sensing period, perform a second one-to-one connection of the plurality of sensing lines to the plurality of sample-and-hold circuits in a second order opposite to the first order; and an analog-to-digital converting circuit configured to, in the first sensing period, generate a plurality of first sensing values based on respective outputs of the plurality of sample-and-hold circuits, and, in the second sensing period, generate a plurality of second sensing values based on the respective outputs of the plurality of sample-and-hold circuits.

According to another aspect of the disclosure, there is provided a data driver including: a plurality of sample-and-hold circuits configured to perform a sampling operation on a plurality of sensing signals corresponding to a plurality of pixels respectively received via a plurality of sensing lines of a display panel; at least one converting circuit configured to generate a plurality of sensing values by performing an analog-to-digital conversion on outputs of the sample-and-hold circuits; and an operation circuit configured to generate a reference sensing value to be used for compensating image data to be displayed on the display panel, by averaging at least two sensing values corresponding to at least two sample-and-hold circuits not being adjacent to each other, among the plurality of sample-and-hold circuits.

BRIEF DESCRIPTION OF THE DRAWINGS

The above and/or other aspects of the disclosure will become apparent and more readily appreciated from the following description of the example embodiments, taken in conjunction with the accompanying drawings, in which.

DETAILED DESCRIPTION

Hereinafter, various example embodiments of the disclosure are described in conjunction with the accompanying drawings.

Figure 1:
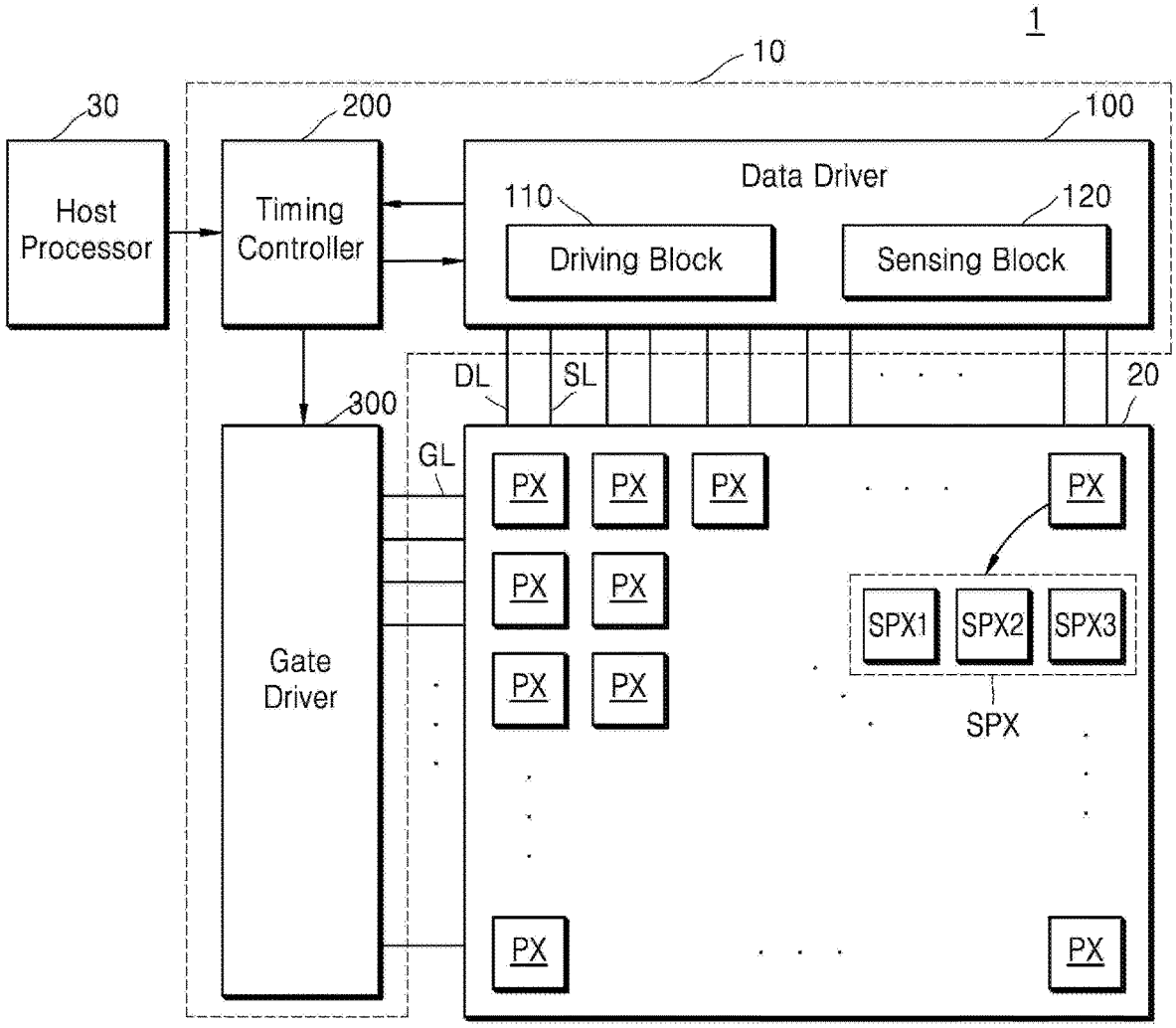
FIG. 1 is a block diagram of a display system according to an example embodiment of the disclosure.

FIG. 1 is a block diagram of a display system 1 according to an example embodiment of the disclosure.

The display system 1 according to an example embodiment of the disclosure may be mounted on an electronic device having an image display function. For example, the electronic device may include a smartphone, a tablet personal computer (PC), a portable multimedia player (PMP), a camera, a wearable device, a television, a digital video disk (DVD) player, a refrigerator, an air conditioner, an air purifier, a set-top box, various medical devices, a navigation device, a global positioning system (GPS) receiver, an automobile device, furniture or various measuring devices, etc.

Referring to FIG. 1, the display system 1 may include a display drive circuit 10, a display panel 20, and a host processor 30. The display drive circuit 10 may include a timing controller 200, a data driver 100, and a gate driver 300. The display drive circuit 10 and the display panel 20 may be implemented as a single module and may be referred to as a display device.

The host processor 30 may control an overall operation of the display system 1. The host processor 30 may generate image data to be displayed on the display panel 20 and transmit the image data and control commands to the display driving circuit 10. The host processor 30 may include a graphics processor. However, the disclosure is not limited thereto, and the host processor 30 may be implemented by various types of processors such as a central processing unit (CPU), a microprocessor, a multimedia processor, and an application processor. In an example embodiment, the host processor 30 may be implemented as an integrated circuit (IC) or a system on chip (SoC).

The display panel 20 may include a plurality of signal lines such as a plurality of gate lines GL, a plurality of data lines DL, and a plurality of sensing lines SL and may include a plurality of pixels PX arranged in a matrix form.

Each of the plurality of pixels PX may include subpixels SPX, for example, a first subpixel SPX1, a second subpixel SPX2, and a third subpixel SPX3. Each of the plurality of subpixels SPX included in the display panel 20 may be connected to a corresponding gate line GL, a corresponding data line DL, and a corresponding sensing line SL. In an example embodiment, the subpixels SPX included in one pixel PX may be connected to the same sensing line SL.

The subpixels SPX included in one pixel PX may represent different colors. For example, red (R), green (G), and blue (B) subpixels may be included in one pixel PX. In other words, the pixel PX may have an RGB structure. However, the disclosure is not limited thereto. For example, the pixel PX may have an RGBW structure further including a white (W) subpixel for luminance enhancement. Alternatively, the pixel PX may be implemented as a combination of subpixels SPX of different colors.

In an example embodiment, the display panel 20 may include an organic light emitting diode (OLED) display panel in which each subpixel SPX includes an OLED. However, the disclosure is not limited thereto, and the display panel 20 may be implemented as other type of flat panel displays or flexible display panels.

The timing controller 200 may control driving timings of the data driver 100 and the gate driver 300 based on control commands received from the host processor 30. The timing controller 200 may perform various image processes for changing a format of the image data, reducing power consumption, etc., to the image data received from the host processor 30. For example, when the display panel 20 has the RGBW structure and the received image data has an RGB data format corresponding to the RGB structure, the timing controller 200 may change the data format of the image data from the RGB data format to an RGBW data format by performing a data format changing process on the image data. The timing controller 200 may provide image-processed image data to the data driver 100.

The timing controller 200 may also perform data compensation, that is, compensation for the image data in the image processing operation and provide the compensated image data to the data driver 100. The timing controller 200 may include a data compensator (not shown). The timing controller 200 (or the data compensator of the timing controller 200) may receive from the data driver 100 a reference sensing value indicating electrical characteristics of each of a plurality of subpixels SPX (or subpixels SPX in compensation units) included in the display panel 20 and may generate compensation values for compensating for changes in the electrical characteristics due to variations or deterioration in the electrical characteristics of each of the plurality of subpixels SPX based on the reference sensing value. For example, the electrical characteristics may include a threshold voltage of a driving transistor included in the subpixel SPX, the mobility of the driving transistor, a threshold voltage of the OLED, etc. The timing controller 200 may store the compensation values either internally or externally and may perform the data compensation on the image data based on the compensation values.

The gate driver 300 may drive the plurality of gate lines GL of the display panel 20 by using a gate control signal received from the timing controller 200. Based on the gate control signal, the gate driver 300 may provide pulses of a gate-on voltage, for example, a scan voltage or a sensing-on voltage, to the corresponding gate line GL during a corresponding driving interval of each of the plurality of gate lines GL.

The data driver 100 may include a driving block 110 and a sensing block 120, drive the plurality of subpixels PX via a plurality of data lines DL, and measure the electrical characteristics of the plurality of subpixels SPX.

The driving block 110 may perform a digital-to-analog converting operation on the received image data and may provide data signals, which are converted analog signals, to the display panel 20 via the plurality of data lines DL. The data signals may be provided to the plurality of subpixels SPX, respectively.

The driving block 110 may, in a display mode and/or a sensing mode, convert the image data provided by the timing controller 200 and/or an sensing data (e.g., internally set sensing data) into data signals, for example, data voltages, and may output the data voltages to the display panel 20 via the data lines DL. The driving block 110 may include a plurality of digital-to-analog converters, and each of the plurality of digital-to-analog converters may convert input data (for example, subpixel data) into the data voltages.

The sensing block 120 may periodically or non-periodically measure electrical characteristics of the plurality of subpixels SPX. The sensing block 120 may measure the electrical characteristics of the plurality of subpixels SPX in the sensing mode, and the sensing mode may be set in a test step in a manufacturing process of the display device, a booting period after power-on of the display system 1, a terminating period at power-off, and/or dummy intervals (or vertical blanking intervals) between frame display periods of the display panel 20.

The sensing block 120 may receive a sensing signal, for example, a pixel voltage or a pixel current, indicating the electrical characteristics of each of the plurality of subpixels SPX via the plurality of sensing lines SL and may generate sensing values through an analog-to-digital converting operation of the received sensing signal.

The sensing block 120 may simultaneously perform a sampling operation on a plurality of sensing signals received via the plurality of sensing lines SL and sequentially perform the analog-to-digital converting operation on the sampled sensing signals. The sensing block 120 may include a plurality of sample-and-hold circuits (SH in FIG. 3A) for simultaneously sampling the plurality of sensing signals and may include at least one analog-to-digital converter (ADC) for the analog-to-digital converting operation.

An output deviation (or a channel deviation), for example, a gain deviation or an offset, may occur between a plurality of sample-and-hold circuits SH, and the output deviation between the plurality of sample-and-hold circuits SH may affect the plurality of sensing values that are generated based on the plurality of sensing signals. For example, even when a first sensing signal and a second sensing signal of the same level are input to a first sample-and-hold circuit SH and a second sample-and-hold circuit SH, respectively, a first sensing value generated based on the first sensing signal may be different from a second sensing value generated based on the second sensing signal due to an output deviation between the first sample-and-hold circuit SH and the second sample-and-hold circuit SH.

The output deviation between the plurality of sample-and-hold circuits SH may show a tendency of linearly increasing or decreasing according to a distance on a layout between the plurality of sample-and-hold circuits SH. For example, when a distance between the first sample-and-hold circuit SH and the second sample-and-hold circuit SH is greater than a distance between the first sample-and-hold circuit SH and a third sample-and-hold circuit SH, an output deviation between the first sample-and-hold circuit SH and the second sample-and-hold circuit SH may be greater than an output deviation between the first sample-and-hold circuit SH and the third sample-and-hold circuit SH.

The sensing block 120 according to an example embodiment of the disclosure may internally remove offsets of the plurality of sensing values due to the output deviations between the plurality of sample-and-hold circuits SH inside the data driver 100, without performing a separate data compensation operation. The sensing block 120 may generate the reference sensing value to be used for the compensation by averaging at least two sensing values of the analog-to-digital converted outputs of the at least two sample-and-hold circuits SH among the plurality of sample-and-hold circuits SH. The plurality of reference sensing values generated by averaging at least two sensing values of the plurality of sensing values may not include an offset due to an output deviation between the plurality of sample-and-hold circuits SH, or may have values in which the offset is reduced (or minimized).

In an example embodiment, while the sensing block 120 samples (or senses) the plurality of sensing signals at least two times by using the plurality of sample-and-hold circuits SH, the sensing block 120 may perform the sampling operation on the sensing signals in different sample-and-hold circuits SH from each other through a channel switching that changes the sensing signal applied to each of the plurality of sample-and-hold circuits SH, and may generate the reference sensing value by averaging at least two sensing values generated based on the sensing signals.

In an example embodiment, the sensing block 120 may provide odd-numbered sensing signals among the plurality of sensing signals to the first sample-and-hold circuit SH in a first region of the plurality of sample-and-hold circuits SH, provide even-numbered sensing signals among the plurality of sensing signals to the second sample-and-hold circuit SH in a second region of the plurality of sample-and-hold circuits SH, and may correspondingly average sensing values generated based on an output of the first sample-and-hold circuit SH and sensing values generated based on an output of the second sample-and-hold circuit SH. At this time, the averaged sensing values may correspond to sensing signals output from adjacent subpixels SPX among the even-numbered sensing signals and the odd-numbered sensing signals.

According to example embodiments of the disclosure, a separate calibration operation for measuring the output deviation between the plurality of sample-and-hold circuits SH, that is, the channel deviation, and generating a channel deviation compensation value based on the measured channel deviation may be omitted. Since the compensation of the channel deviation is internally performed in the data driver 100, that is, in the sensing block 120, compensation of the channel deviation may not be required in the timing controller. Accordingly, a compensation algorithm may be simplified and a load of the timing controller 200 performing the compensation may be reduced.

Figure 2:
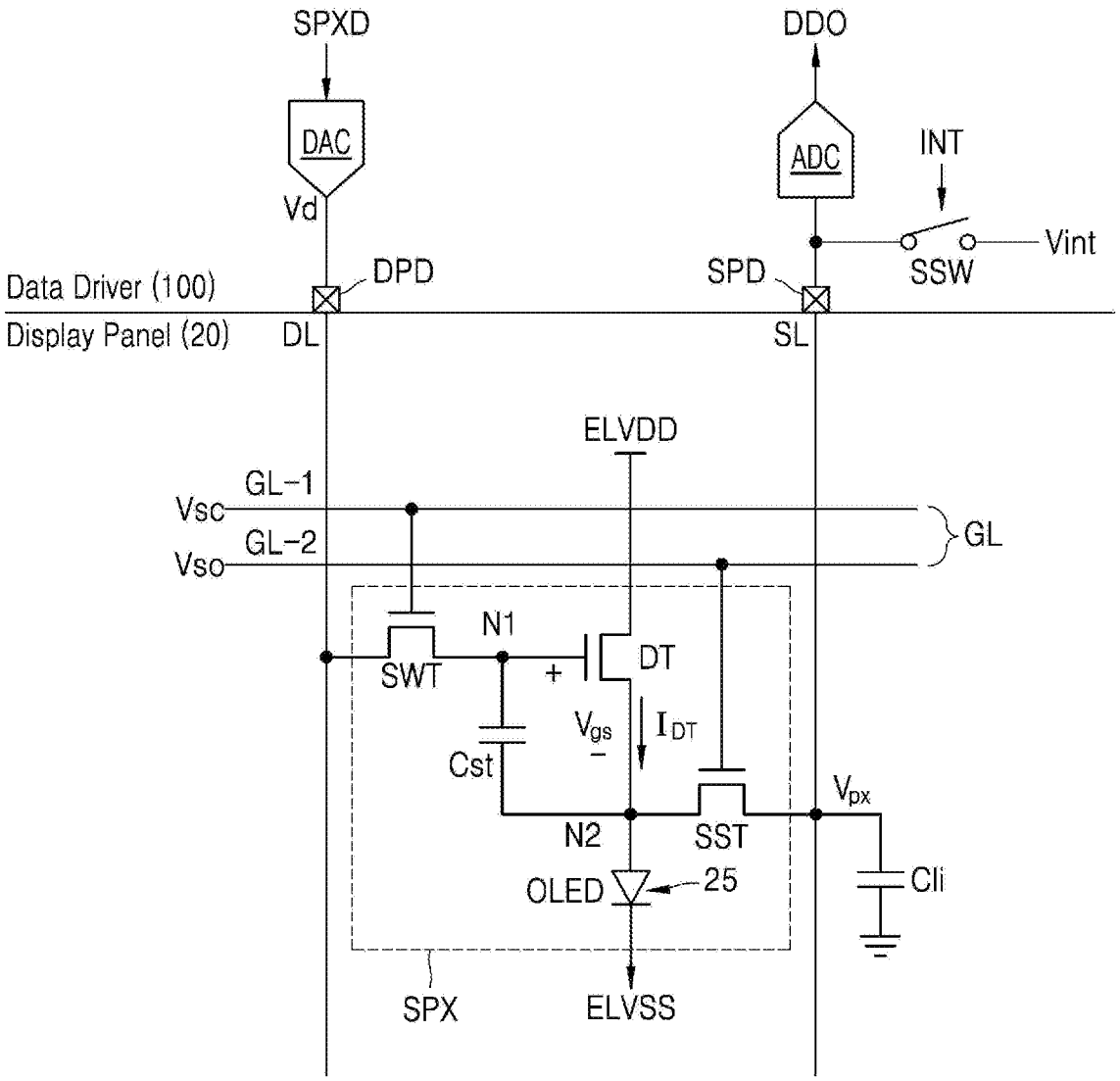
FIG. 2 is an equivalent circuit of a subpixel according to an example embodiment of the disclosure.

FIG. 2 is an equivalent circuit of the subpixel SPX according to an example embodiment of the disclosure. For convenience of explanation, some components of the data driver 100 are illustrated together.

Referring to FIG. 2, the subpixel SPX may include a switching transistor SWT, a driving transistor DT, an OLED 25, a storage capacitor Cst, and a sensing transistor SST. However, a configuration and a structure of the subpixel SPX in FIG. 2 are only examples of a subpixel SPX circuit, and the configuration and the structure of the subpixel SPX may be variously changed.

A first driving voltage ELVDD and a second driving voltage ELVSS may be applied to the subpixel SPX. The first driving voltage ELVDD may be relatively greater than the second driving voltage ELVSS.

The switching transistor SWT, the sensing transistor SST, and the driving transistor DT may include an amorphous silicon (a-Si) thin film transistor (TFT), a poly-silicon (poly-Si), an oxide TFT, an organic TFT, etc.

The gate line GL connected to the subpixel PSX may include a first gate line GL-1 and a second gate line GL-2. The switching transistor SWT may be connected to the first gate line GL-1 and the data line DL and may turn on in response to a scan voltage Vsc applied via the first gate line GL-1 and provide a data signal, for example, a data voltage Vd, which is output from the data driver 100 through a driving pad DPD and is provided via the data line DL, to a gate node N1 of the driving transistor DT. The data voltage Vd may be generated in a digital-to-analog converter DAC of the data driver 100. A plurality of digital-to-analog converters DAC may be equipped in the driving block (110 in FIG. 1) to generate data voltages Vd provided to the plurality of data lines (DL in FIG. 1).

The sensing transistor SST may be connected to a second gate line GL-2 and the sensing line SL and may be turned on by a sensing-on voltage Vso applied via the second gate line GL-2. In this case, the sensing switch SSW of the data driver 100 may be turned on in response to an initial signal INT and provide an initialization voltage Vint (or a reset voltage) to the subpixel SPX via the sensing line SL. The sensing transistor SST may provide the initialization voltage Vint provided by the data driver 100 to a source node N2 of the driving transistor DT. The sensing transistor SST may also be turned on in the sensing mode and output a current from the driving transistor DT or the OLED 25 to the sensing line SL.

The storage capacitor Cst may supply a constant driving voltage Vgs to the driving transistor DT in a certain interval, for example, during a frame, by storing a difference between the data voltage Vd applied to the gate node N1 of the driving transistor DT via the switching transistor SWT and the initialization voltage Vint supplied to the source node N2 of the driving transistor DT via the sensing transistor SST.

The first driving voltage ELVDD may be applied to a drain node of the driving transistor DT, and the driving transistor DT may supply a driving current $I_{DT}$ proportional to the driving voltage Vgs to the OLED 25.

The OLED 25 may include an anode connected to the source node N2 of the driving transistor DT, a cathode to which the second driving voltage ELVSS is applied, and an organic light emitting layer between the cathode and the anode. The cathode may be a common electrode shared by all subpixels SPX. The OLED 25 may emit light from the organic light emitting layer thereof when the driving current $I_{DT}$ is supplied from the driving transistor DT. Intensity of the light may be proportional to the driving current $I_{DT}$. The driving current $I_{DT}$ may be expressed by Formula 1.

$$I_{DT}=\beta(Vgs-Vth)^2=\beta(Vd-Vint-Vth)^2 \quad \text{[Formula 1]}$$

Here, β may represent a constant value determined by the mobility of the driving transistor DT, and Vth may represent a threshold voltage of the driving transistor DT.

In the sensing mode, the electrical characteristics of the subpixel SPX may be obtained. The switching transistor SWT may supply the data voltage Vd applied via the data line DL for sensing to the driving transistor DT. When the sensing transistor SST is turned on, the driving current $I_{DT}$ proportional to a difference between a voltage of the gate node N1 of the driving transistor DT and a voltage of the source node N2, in other words, proportional to the driving voltage Vgs, may flow through the sensing line SL and may charge a parasite capacitor of the sensing line SL, that is, a line capacitor Cli.

According to various sensing sequences, the analog-to-digital converter ADC may obtain a voltage of the sensing line SL received via a sensing pad SPD, that is, a pixel voltage Vps at a time point when the voltage of the source node N2 of the driving transistor DT reaches a saturation state or when the voltage of the source node N2 linearly increases. The pixel voltage Vps measured at the time when the voltage of the source node N2 reaches the saturation state may include information about the threshold voltage Vth of the driving transistor DT, and the pixel voltage Vps measured at the time when the voltage of the source node N2 linearly increases may include information about the mobility of the driving transistor DT.

For example, when the threshold voltage Vth of the subpixel SPX increases, and even if the same data voltage Vd is supplied to the subpixel SPX, the driving current $I_{DT}$ may decrease, and accordingly, an amount of light output from the OLED 25 may be reduced.

To compensate for an increase in the threshold voltage Vth, the increase amount of the threshold voltage Vth through the measurement of the electrical characteristics of the subpixel SPX may be detected, and based on the increased amount, subpixel data SPXD may be compensated (in other words, a value of the subpixel data SPXD may be adjusted). The digital-to-analog converter DAC may generate the data voltage Vd based on the adjusted subpixel data SPXD, and the level of the data voltage Vd may be increased. Accordingly, the driving voltage Vgs may be increased, and thus, a decrease of the driving current $I_{DT}$ due to the increase of the threshold voltage Vth may be canceled (or offset) by the increase of the driving voltage Vgs.

In this manner, by performing the compensation based on the measurement of the electric characteristics of each of the plurality of subpixels SPX and the measured values (e.g., the pixel voltage), a change in the electrical characteristics due to the deviation or deterioration of the electrical characteristics of the plurality of subpixels SPX may be compensated.

Figure 3A:
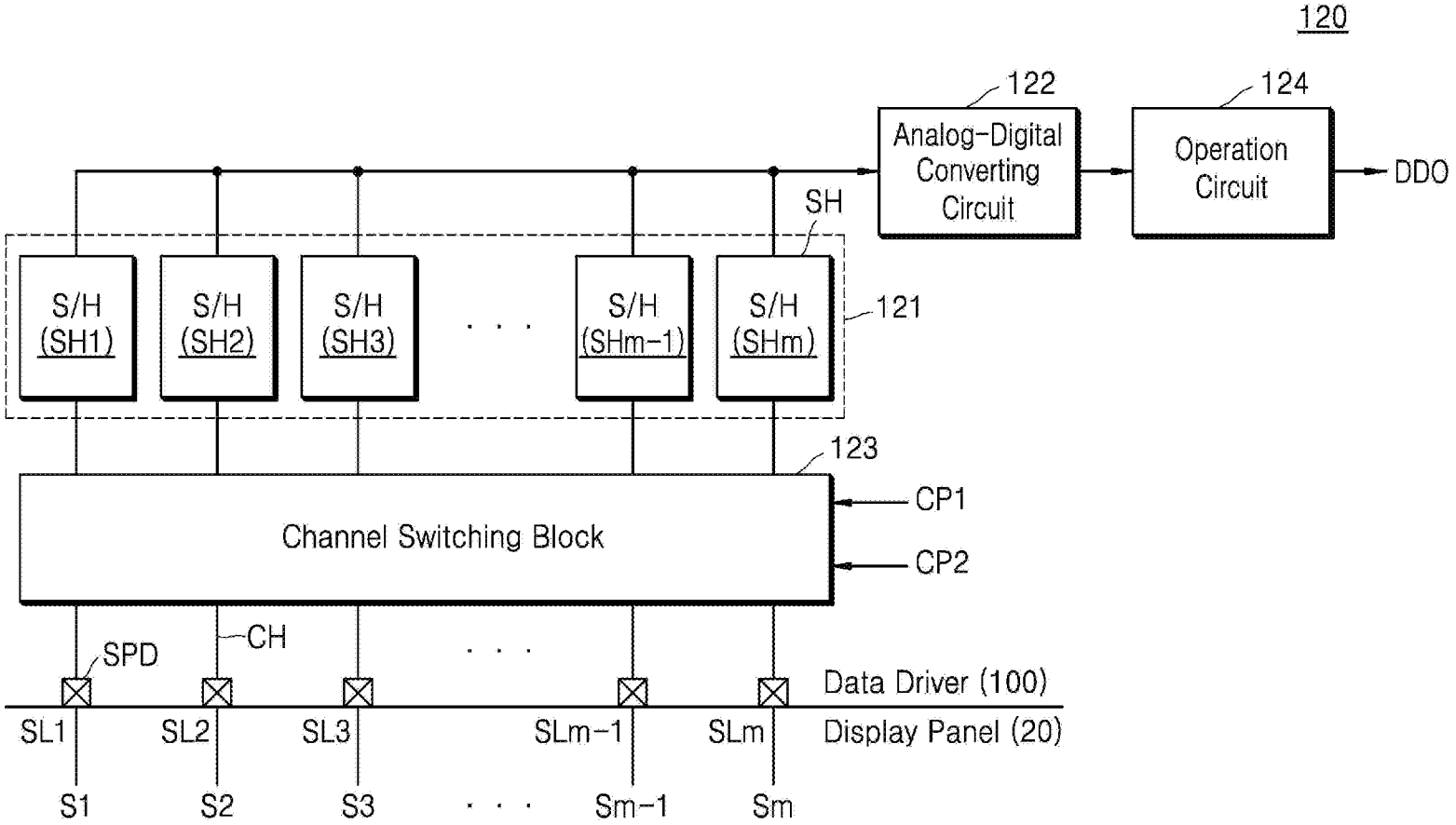
FIG. 3A is a schematic block diagram of a sensing block, according to an example embodiment of the disclosure.
Figure 3B:
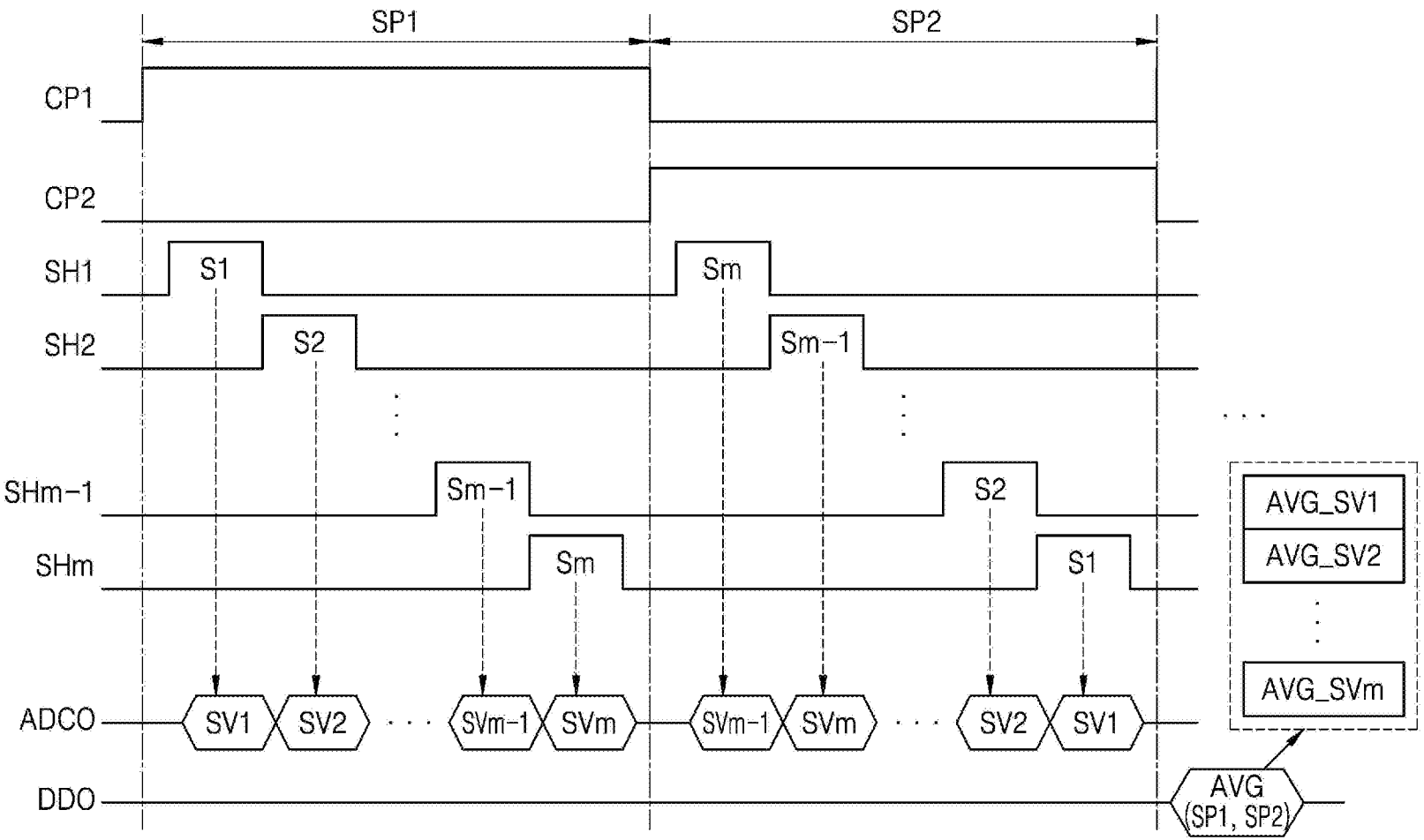
FIG. 3B is a timing diagram illustrating an operation of the sensing block of FIG. 3A.

FIG. 3A is a schematic block diagram of the sensing block 120, according to an example embodiment of the disclosure, and FIG. 3B is a timing diagram illustrating an operation of the sensing block 120 of FIG. 3A.

Referring to FIG. 3A, the sensing block 120 may include a sampling block 121, an analog-to-digital converting circuit 122, and a channel switching block 123. The sensing block 120 (or the driving block (110 of FIG. 1)) may further include an operation circuit 124.

A plurality of sensing signals, for example, first through $m^{th}$ sensing signals S1 through Sm (where m is an integer of 4 or more), may be received through the first through $m^{th}$ sensing lines SL1 through SLm, and the first through $m^{th}$ sensing signals S1 through Sm may be provided to each of the plurality of sample-and-hold circuits SH of the sampling block 121 via the channel switching block 123.

The sampling block 121 may include the plurality of sample-and-hold circuits SH, for example, first through $m^{th}$ sample-and-hold circuits SH1 through SHm. The first through $m^{th}$ sample-and-hold circuits SH1 through SHm may simultaneously perform the sampling operation on the first through $m^{th}$ sensing signals S1 through Sm, respectively, and then outputs of the first through $m^{th}$ sample-and-hold circuits SH1 through SHm may be sequentially provided to the analog-to-digital converting circuit 122. In other words, the first through $m^{th}$ sensing signals S1 through Sm may be sequentially supplied to the analog-to-digital converting circuit 122 through the first through $m^{th}$ sample-and-hold circuits SH1 through SHm, respectively. Since the first through $m^{th}$ sensing signals Si through Sm respectively received by the first through $m^{th}$ sample-and-hold circuits SH1 through SHm are provided to the analog-to-digital converting circuit 122, the first through $m^{th}$ sample-and-hold circuits SH1 through SHm may be referred to as channels for the first through $m^{th}$ sensing signals S1 through Sm, respectively.

The channel switching block 123 may provide the first through $m^{th}$ sensing signals S1 through Sm to the first through $m^{th}$ sample-and-hold circuits SH1 through SHm, respectively, and may perform the channel switching operation in which channels of the first through $m^{th}$ sensing signals S1 through Sm are changed.

The channel switching block 123 may provide, in a first sensing period, each of the first through $m^{th}$ sensing signals S1 through Sm to a first sample-and-hold circuit SH that is selected among the first through $m^{th}$ sample-and-hold circuits SH1 through SHm in response to a first switching signal CP1 (or, referred to as a chopping signal), and may provide, in a second sensing period, each of the first through $m^{th}$ sensing signals S1 through Sm to a second sample-and-hold circuit SH that is selected among the first through $m^{th}$ sample-and-hold circuits SH1 through SHm in response to a second switching signal CP2.

For example, the channel switching block 123 may provide, in the first sensing period, the first sensing signal S1 to the first sample-and-hold circuit SH1 in response to the first switching signal CP1 and may provide, in the second sensing period, the first sensing signal S1 to the $m^{th}$ sample-and-hold circuit SHm in response to the second switching signal CP2. On the other hand, the channel switching block 123 may provide, in the first sensing period, the $m^{th}$ sensing signal Sm to the $m^{th}$ sample-and-hold circuit SHm in response to the first switching signal CP1 and may provide, in the second sensing period, the $m^{th}$ sensing signal Sm to the first sample-and-hold circuit SH1 in response to the second switching signal CP2.

In an example embodiment, the channel switching block 123 may provide, in the first sensing period, according to a first order, the first through $m^{th}$ sensing signals S1 through Sm to the first through $m^{th}$ sample-and-hold circuits SH1 through SHm, respectively, and may provide, in the second sensing period, according to a second order opposite to the first order, the $m^{th}$ through first sensing signals Sm through S1 to the first through $m^{th}$ sample-and-hold circuits SH1 through SHm, respectively.

In an example embodiment, the channel switching block 123 may perform the channel switching operation, in response to the first switching signal CP1 and the second switching signal CP2, by respectively changing electrical connection relations between the first through $m^{th}$ sensing lines SL1 through SLm in which the first through $m^{th}$ sensing signals S1 through Sm are respectively received and the first through $m^{th}$ sample-and-hold circuits SH1 through SHm.

The analog-to-digital converting circuit 122 may sequentially receive respective outputs of the first through $m^{th}$ sample-and-hold circuits SH1 through SHm, and amplify and perform the analog-to-digital converting operation on the received respective outputs. In this manner, the plurality of sensing values corresponding to the first through $m^{th}$ sensing signals S1 through Sm may be generated.

The analog-to-digital converting circuit 122 may generate, in the first sensing period, m first sensing values corresponding to the first through $m^{th}$ sensing signals S1 through Sm and may generate, in the second sensing period, m second sensing values corresponding to the first through $m^{th}$ sensing signals S1 through Sm. An average value of two sensing values (that is, the first sensing value and the second sensing value) corresponding to the same sensing signal among the m first sensing values generated in the first sensing period and the m second sensing values generated in the second sensing period may be generated as a reference sensing value. For example, the operation circuit 124 may generate m reference sensing values, by averaging two sensing values corresponding to the sensing signal for each of the first through $m^{th}$ sensing signals S1 through Sm, and thus, generating the reference sensing value. A data driver output DDO including m reference sensing values may be provided to the timing controller (200 in FIG. 1).

The operation of the sensing block 120 of FIG. 3A is illustratively described with reference to FIG. 3B. In the first sensing period SP1, the first switching signal CP1 may be transitioned to an active level (for example, logic high), and the channel switching block 123 may, in response to the active level of the first switching signal CP1, respectively provide the first through the $m^{th}$ sensing signals S1 through Sm to the first through the $m^{th}$ sample-and-hold circuits SH1 through SHm, and the first through the $m^{th}$ sample-and-hold circuits SH1 through SHm may simultaneously and respectively perform the sampling operation on the first through $m^{th}$ sensing signals S1 through Sm.

The first through $m^{th}$ sample-and-hold circuits SH1 through SHm may sequentially output the sampled signals to the analog-to-digital converting circuit 122, and the analog-to-digital converting circuit 122 may sequentially convert outputs of the first through $m^{th}$ sample-and-hold circuits SH1 through SHm to generate the first through $m^{th}$ sensing values SV1 through SVm, respectively. In the first sensing period SP1, an analog-to-digital converting output (ADCO) of the analog-to-digital converting circuit 122 may include the first through $m^{th}$ sensing values SV1 through SVm.

Next, in the second sensing period SP2, the second switching signal CP2 may be transitioned to the active level (for example, logic high), and the channel switching block 123 may provide, in response to the active level of the second switching signal CP2, the $m^{th}$ through first sensing signals Sm through S1 to the first through $m^{th}$ sample-and-hold circuits SH1 through SHm, respectively, and the first through $m^{th}$ sample-and-hold circuits SH circuits SH1 through SHm may simultaneously and respectively perform the sampling operation on the $m^{th}$ through first sensing signals Sm through S1.

The first through $m^{th}$ sample-and-hold circuits SH1 through SHm may sequentially output the sampled signals to the analog-to-digital converting circuit 122, and the analog-to-digital converting circuit 122 may sequentially generate and output the $m^{th}$ through first sensing values SVm through SV1 respectively corresponding to the $m^{th}$ through first sensing signals Sm through S1.

The operation circuit 124 may average the two sensing values corresponding to the same sensing signal among the sensing values output from the analog-to-digital converting circuit 122 in the first sensing period SP1 and the second sensing period SP2. For example, the operation circuit 124 may generate a first reference sensing value AVG_SV1 by averaging the first sensing value SV1 output in the first sensing period SP1 and the first sensing value SV1 output in the second sensing period SP2. The first sensing value SV1 output in the first sensing period SP1 may be a value obtained by analog-to-digitally converting the output of the first sample-and-hold circuit SH1, and the first sensing value SV1 output in the second sensing period SP2 may be a value obtained by analog-to-digitally converting the output of the $m^{th}$ sample-and-hold circuit SHm. By averaging the first sensing value SV1 output in the first sensing period SP1 and the first sensing value SV1 output in the second sensing period SP2, the output deviation between the first sample-and-hold circuit SH1 and the $m^{th}$ sample-and-hold circuit SHm may be canceled.

In this manner, the operation circuit 124 may generate the first through $m^{th}$ reference sensing values AVG_SV1 through AVG_SVm, by averaging a sensing value corresponding to an output of the $(1+n)_{th}$ sample-and-hold circuit SH (n is an integer less than m) among the first through $m^{th}$ sensing values SV1 through SVm generated in the first sensing period SP1 and a sensing value corresponding to an output of the $(m-n)^{th}$ sample-and-hold circuit SH among the first through $m^{th}$ sensing values SV1 through SVm generated in the second sensing period SP2. The data driver output DDO of the data driver 100 including the first through $m^{th}$ reference sensing values AVG_SV1 through SVG_SVm may be provided to the timing controller (200 in FIG. 1), and the timing controller 200 may determine data compensation values for the plurality of subpixels SPX based on the received first through $m^{th}$ reference sensing values AVG_SV1 through AVG_SVm.

Figure 4:
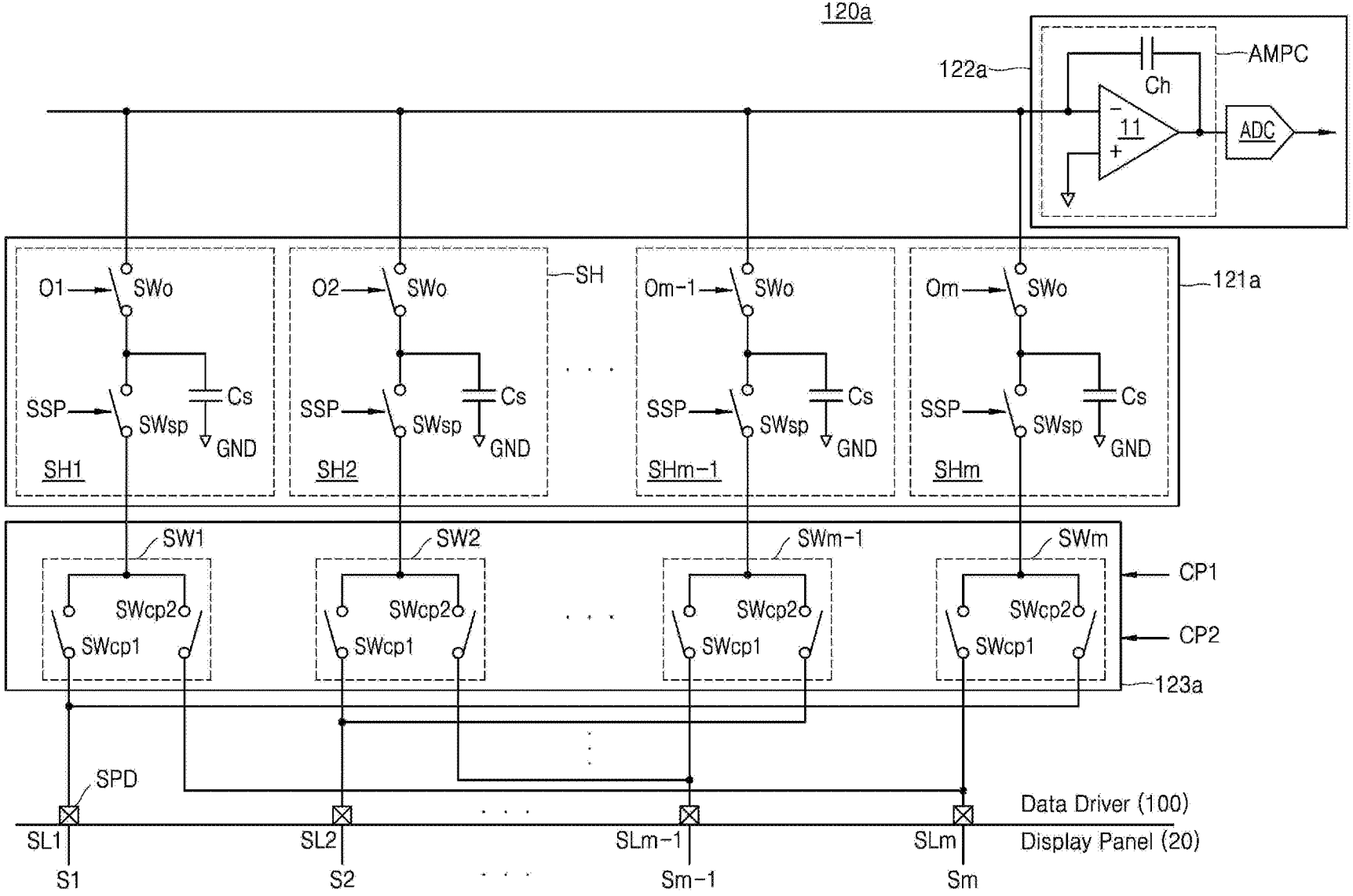
FIG. 4 is a circuit diagram of a sensing block according to an example embodiment of the disclosure.

FIG. 4 is a circuit diagram of a sensing block 120*a* according to an example embodiment of the disclosure.

Referring to FIG. 4, the sensing block 120*a* may include a sampling block 121*a*, an analog-to-digital converting circuit 122*a*, and a channel switching block 123*a*.

The sampling block 121*a* may include a plurality of sample-and-hold circuits SH, for example, the first through $m^{th}$ sample-and-hold circuits SH1 through SHm, and each of the plurality of sample-and-hold circuits SH may include a sampling switch SWsp, a sampling capacitor Cs, and an output switch SWo. The plurality of sample-and-hold circuits SH may be arranged in succession on a layout, and in an example embodiment, different circuits between the plurality of sample-and-hold circuits SH, for example, the digital-to-analog converter DAC of the driving block (110 in FIG. 1), may be arranged.

Each sampling switch SWsp of the plurality of sample-and-hold circuits SH may be turned on in response to a sampling signal SSP, and a received signal, for example, a sensing signal, may be stored in the sampling capacitor Cs. Next, the output switch SWo of each of the plurality of sample-and-hold circuits SH may be sequentially turned on, and the sampled signals may be sequentially provided to the analog-to-digital converting circuit 122*a*. The m output switches SWo provided in the first through $m^{th}$ sample-and-hold circuits SH1 through SHm may be turned on in response to corresponding output signals among first through $m^{th}$ output signals O1 through Om, respectively, and may output the sampled signals. For example, the output switch SWo of the first sample-and-hold circuit SH1 may be turned on in response to the first output signal O1 and output a sampled signal, and the output switch SWo of the second sample-and-hold circuit SH2 may be turned on in response to the second output signal O2 and output a sampled signal. Accordingly, the first through $m^{th}$ sample-and-hold circuits SH1 through SHm may sequentially output the sampled signals.

The channel switching block 123*a* may include a plurality of switching units (e.g., a plurality of switches), for example, first through $m^{th}$ switching units SW1 through SWm. Each of the first through $m^{th}$ switching units SW1 through SWm may selectively provide two corresponding sensing signals among the first through $m^{th}$ sensing signals S1 through Sm received via the first through $m^{th}$ sensing lines SL1 through SLm of the display panel 20 to a corresponding sample-and-hold circuit SH among the first through $m^{th}$ sample-and-hold circuits SH1 through SHm.

Each of the first through $m^{th}$ switching units SW1 through SWm may include a first selection switch SWcp1 and a second selection switch SWcp2. The first selection switch SWcp1 may be turned on in response to the first switching signal CP1, and the second selection switch SWcp2 may be turned on in response to the second switching signal CP2. The first switching signal CP1 and the second switching signal CP2 may have an active level (for example, logic high) that turns on the first selection switch SWcp1 and the second selection switch SWcp2 in different periods, and for example, the first switching signal CP1 may have the active level in the first sensing period SP1 and the second switching signal CP2 may have the active level in the second sensing period SP2.

The first through $m^{th}$ sensing signals S1 through Sm may be provided to the first selection switches SWcp1 of the first through $m^{th}$ switching units SW1 through SWm in the first order, and the first through $m^{th}$ sensing signals S1 through Sm may be provided to the second selection switches SWcp2 of the first through $m^{th}$ switching units SW1 through SWm in the second order opposite to the first order. For example, as illustrated in FIG. 4, the first through $m^{th}$ sensing signals S1 through Sm may be provided to the first selection switch SWcp1 in the first order, and the $m^{th}$ through first sensing signals Sm through S1 may be provided to the second selection switch SWcp2 in the second order. In other words, the first through $m^{th}$ sensing signals S1 through Sm may be symmetrically provided to the first selection switches SWcp1 and the second selection switches SWcp2.

For example, as illustrated in FIG. 4, an electrical connection relationship between the first selection switch SWcp1 and the first through $m^{th}$ sensing lines SL1 through SLm may be symmetrical to an electrical connection relationship between the second selection switch SWcp2 and the first through $m^{th}$ sensing lines SL1 through SLm.

Each of the first through $m^{th}$ switching units SW1 through SWm may switch the sensing signal provided to the corresponding sample-and-hold circuit SH in response to the first switching signal CP1 and the second switching signal CP2. Accordingly, the channel switching operation may be performed through a change of the sample-and-hold circuit SH to which each of the first through $m^{th}$ sensing signals S1 through Sm is provided.

The analog-to-digital converting circuit 122*a* may include an amplifying circuit AMPC and an analog-to-digital converter (ADC).

The amplifying circuit AMPC may include an operational amplifier 11 and a gain capacitor Ch, and the gain capacitor Ch may be connected to a first input terminal (−) and an output terminal of the operational amplifier 11, and a ground voltage may be provided to a second input terminal (+) of the operational amplifier 11.

An amplification ratio of each of the first through $m^{th}$ sample-and-hold circuits SH, for example, a gain of an amplified signal, may be determined according to a capacitance ratio of a sampling capacitor Cs included in each of the first through $m^{th}$ sample-and-hold circuits SH and the gain capacitor Ch. The amplifying circuit AMPC may sequentially receive and amplify the outputs of the first through $m^{th}$ sample-and-hold circuits SH1 through SHm, and output amplified values, and the analog-to-digital converter ADC may generate a plurality of sensing values by digital-to-analog conversion of the amplified values.

On the other hand, as described above, output deviations, that is, channel deviations, may occur between the first through $m^{th}$ sample-and-hold circuits SH1 through SHm. A cause of the output deviation between the first through $m^{th}$ sample-and-hold circuits SH1 through SHm is described with reference to FIG. 5.

Figure 5:
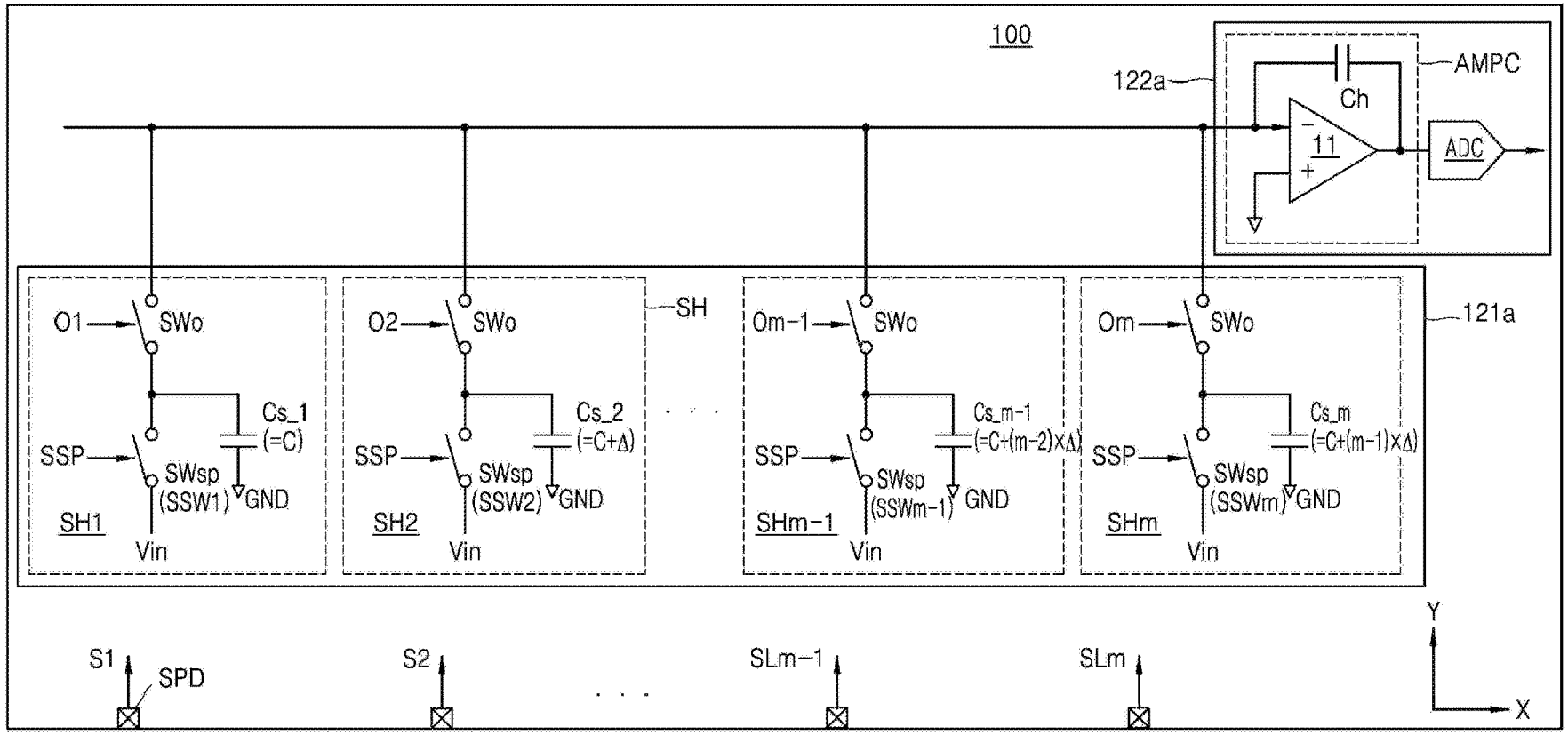
FIG. 5 is a layout diagram of a sampling block of FIG. 4.

FIG. 5 is a diagram of a layout of the sampling block 121*a* in FIG. 4.

The data driver 100 may be implemented as a semiconductor integrated circuit (IC), and a length thereof in a first direction (X-axis direction) may be longer than a length thereof in a second direction (Y-axis direction).

In the first direction, a plurality of sensing pads SPD being connected to the plurality of sensing lines and receiving a plurality of sensing signals, for example, the first through $m^{th}$ sensing signals S1 through Sm may be arranged. The first through $m^{th}$ sample-and-hold circuits SH1 through SHm may be arranged in order in the first direction. Due to process characteristics, the capacitances of the plurality of sampling capacitors provided in the first through $m^{th}$ sample-and-hold circuits SH1 through SHm, for example, the first through $m^{th}$ sampling capacitors Cs_1 through Cs_m may be different from each other. The capacitances of the first through $m^{th}$ sampling capacitors Cs_1 through Cs_m may have a tendency to linearly increase or decrease, depending on positions on the layout. The capacitances of the first through $m^{th}$ sampling capacitors Cs_1 through Cs_m may increase or decrease in the first direction. For example, when the capacitance of the first sampling capacitor Cs_1 of the first sample-and-hold circuit SH1 is C, the capacitance of the second sampling capacitor Cs_2 of the second sample-and-hold circuit SH2 may have a value, C+Δ, wherein Δ denotes a unit deviation. A deviation may increase as the distance between the plurality of sample-and-hold circuits SH increases, and accordingly, the capacitance of the $m^{th}$ sampling capacitor Cs_m of the $m^{th}$ sample-and-hold circuit SHm may have a value, C+(m−1)×Δ, that deviates from C by (m−1) times the unit deviation Δ.

The sampling switches SWsp provided in the first through $m^{th}$ sample-and-hold circuits SH1 through SHm, for example, the first through $m^{th}$ sampling switches SSW1 through SSWm may be implemented as transistors, and the threshold voltages Vth at turn-on times of the first through $m^{th}$ sampling switches SSW1 through SSWm may be different from each other. Accordingly, when the first through $m^{th}$ sampling switches SSW1 through SSWm are turned on, dispersion may occur in on-resistance, and thus a sampling time may be different for each of the first through $m^{th}$ sample-and-hold circuits SH1 through SHm.

Thus, due to layout and process characteristics, the output deviation may occur between the first through $m^{th}$ sample-and-hold circuits SH1 through SHm. However, as described above, in the sampling block 121*a* according to an example embodiment of the disclosure, since the sensing signals are sampled in different sample-and-hold circuits through a channel switching, and the reference sensing value is generated by averaging the sensing values generated based on the samples signals in different sample-and-hold circuits, the output deviations between the first through $m^{th}$ sample-and-hold circuits SH1 through SHm may be canceled.

For example, it is assumed that the capacitance values of the first sampling capacitor Cs_1, the second sampling capacitor Cs_2, the $(m-1)^{th}$ sampling capacitor Cs_m−1, and the $m^{th}$ sampling capacitor Csm are C, C+Δ, C+(m−2)×Δ, C+(m−1)×Δ, respectively, and the same input voltage Vin is applied to the first sample-and-hold circuit SH1, the second sample-and-hold circuit SH2, the $(m-1)^{th}$ sample-and-hold circuit SHm-1, and the $m^{th}$ sample-and-hold circuit SHm. In this case, amplified sensing values of the outputs of the first sample-and-hold circuit SH1, the second sample-and-hold circuit SH2, the $(m-1)^{th}$ sample-and-hold circuit SHm−1, and the $m^{th}$ sample-and-hold circuit SHm may be C/Chv×Vin, (C+Δ)/ChvΔVin, (C+(m−2)×Δ)/Chv×Vin, and (C+(m−1)×Δ)/Chv×Vin, respectively (here, Chv is a capacitance value of the gain capacitor Ch).

An averaged value of the amplified sensing value of the output of the first sample-and-hold circuit SH1 and the amplified sensing value of the output of the $m^{th}$ sample-and-hold circuit SHm may be (C+((m−1)/2×Δ))/Chv×Vin, and an averaged value of the amplified sensing value of the output of the second sample-and-hold circuit SH2 and the output of the $(m-1)^{th}$ sample-and-hold circuit SHm−1 may be also (C+((m−1)/2×Δ)/ChvΔVin. Accordingly, the output deviations, that is, the channel deviations, between the first through $m^{th}$ sample-and-hold circuits SH1 through SHm may be canceled, and the channel deviations may be internally compensated within the data driver 100.

Figure 6:
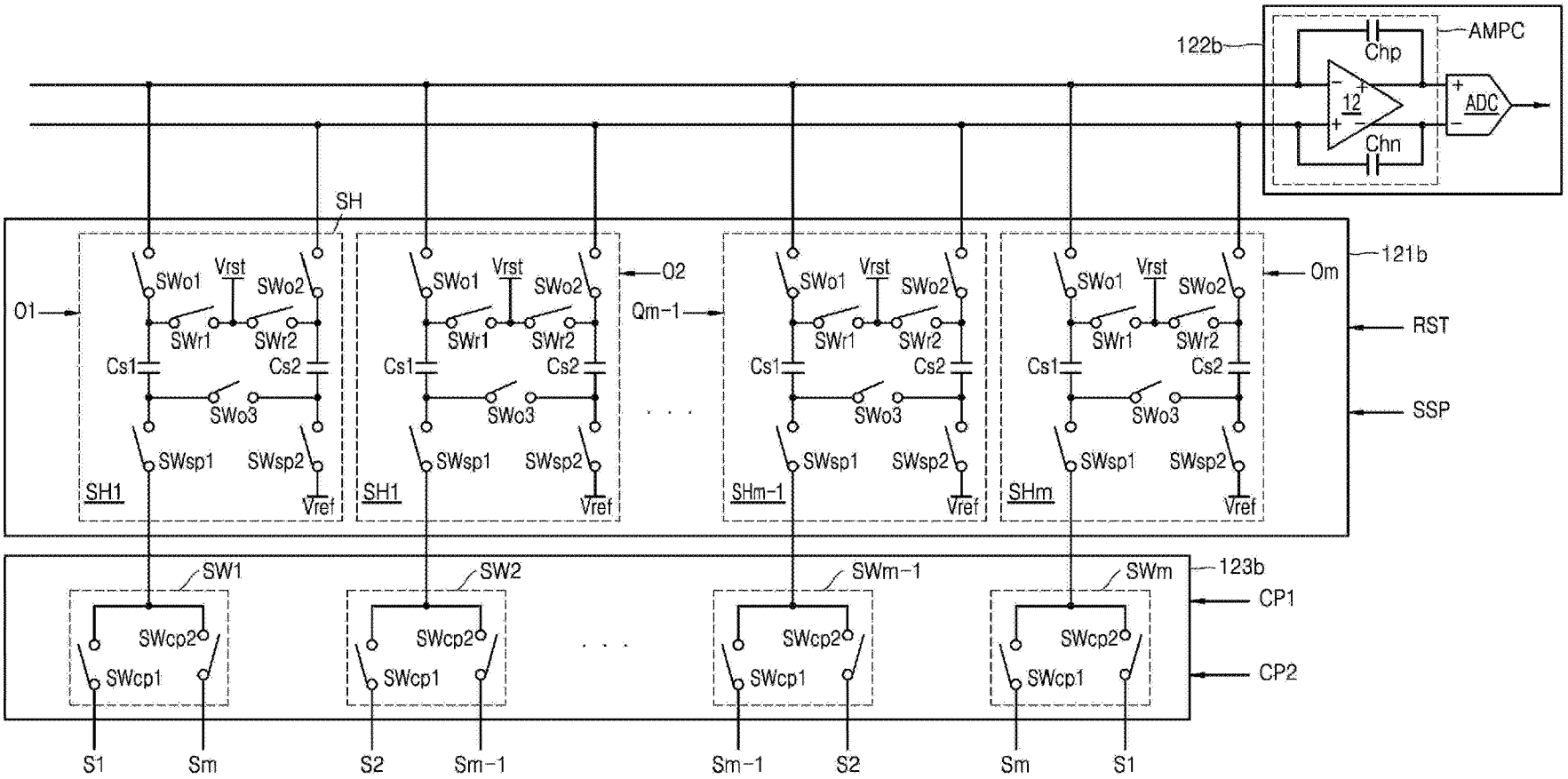
FIG. 6 is a circuit diagram of a sensing block according to an example embodiment of the disclosure.

FIG. 6 is a circuit diagram of a sensing block 120*b* according to an example embodiment of the disclosure.

Referring to FIG. 6, the sensing block 120*b* may include a sampling block 121*b*, an analog-to-digital converting circuit 122*b* and a channel switching block 123*b*.

Since the structure and operation of the channel switching block 123*b* are the same as those of the channel switching block 123*a* in FIG. 4, and descriptions thereof are omitted.

The sampling block 121*b* may include the plurality of sample-and-hold circuits SH, for example, the first through $m^{th}$ sample-and-hold circuits SH1 through SHm, and each of the plurality of sample-and-hold circuits SH may include a first reset switch SWr1 and a second reset switch SWr2, the first sampling switch SWsp1 and a second sampling switch SWsp2, and first through third output switches (SWo1, SWo2, and SWo3).

The analog-to-digital converting circuit 122*b* may include the amplifying circuit AMPC and the analog-to-digital converter ADC. The amplifying circuit AMPC may include a first gain capacitor Chp and a second gain capacitor Chn which are respectively connected to an input terminal and an output terminal of a differential amplifier 12. Capacitances of the first gain capacitor Chp and the second gain capacitor Chn may be the same.

The first and second reset switches SWr1 and SWr2 of each of the plurality of sample-and-hold circuits SH may be turned on in response to a reset signal RST, and a reset voltage Vrst may be applied to a first end of each of the first and second sampling capacitors Cs1 and Cs2. Next, the first and second sampling switches SWsp1 and SWsp2 of each of the plurality of sample-and-hold circuits SH may be turned on in response to the sampling signal SSP, the received sensing signal (for example, input voltage) from the switching block 123*b* may be applied to a second end of the first sampling capacitor Cs1, and a reference voltage Vref may be applied to a second end of the second sampling capacitor Cs2. Accordingly, a voltage corresponding to a difference between the sensing signal and the reset signal Vrst may be stored in the first sampling capacitor Cs1, and a difference between the reference voltage Vref and the reset signal Vrst may be stored in the second sampling capacitor Cs2.

Next, the first and second reset switches SWr1 and SWr2 and the first and second sampling switches SWsp1 and SWsp2 may be turned off, and the first through third output switches SWo1 through SWo3 provided in each of the plurality of sample-and-hold circuits SH may be turned on in response to the corresponding output signal of the first through $m^{th}$ output signals O1 through Om. For example, the first through third output switches SWo1 through SWo3 provided in the first sample-and-hold circuit SH1 may be turned on in response to the first output signal O1. As the third output switch SWo3 is turned on, the first and second sampling capacitors Cs1 and Cs2 may have a charge sharing, a first end of the first sampling capacitor Cs1 may be connected to a first input terminal (−) of the differential amplifier 12, a first end of the second sampling capacitor Cs2 may be connected to a second input terminal (+) of the differential amplifier 12, and thus a difference between voltages stored in each of the first sampling capacitor Cs1 and the second sampling capacitor Cs2 may be provided to the differential amplifier 12 as a differential signal (for example, differential voltage). The amplifying circuit AMPC may amplify the received differential signal, and provide the amplified differential voltage to the analog-to-digital converter ADC.

Figure 7:
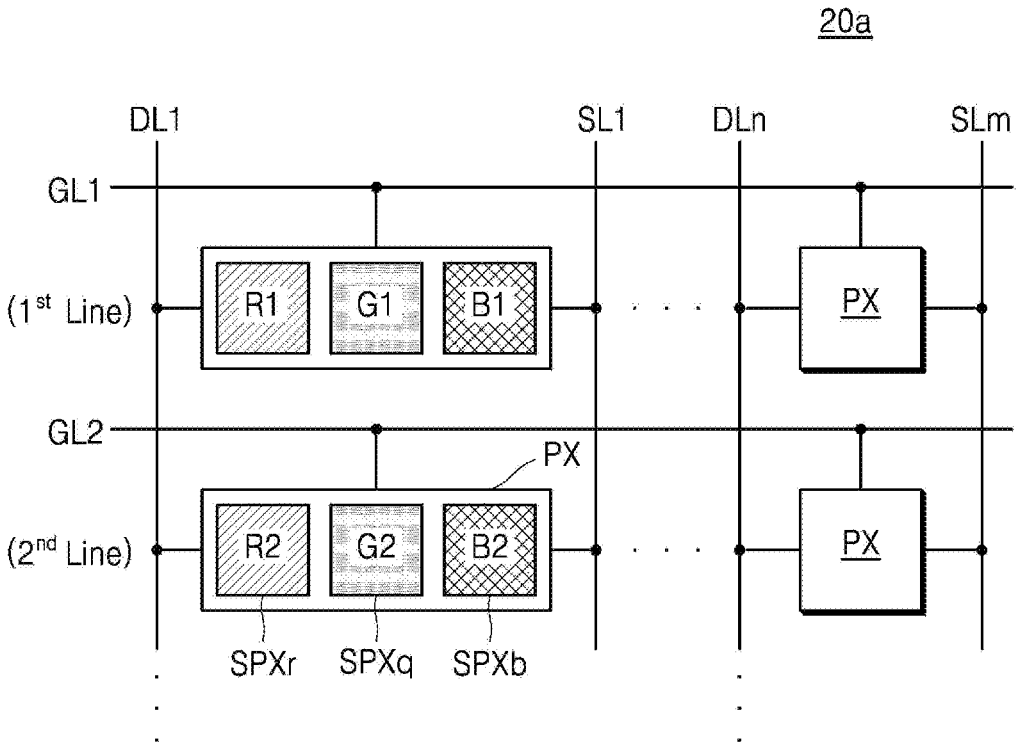
FIG. 7 illustrates an example of a pixel array structure of a display panel.
Figure 8A:
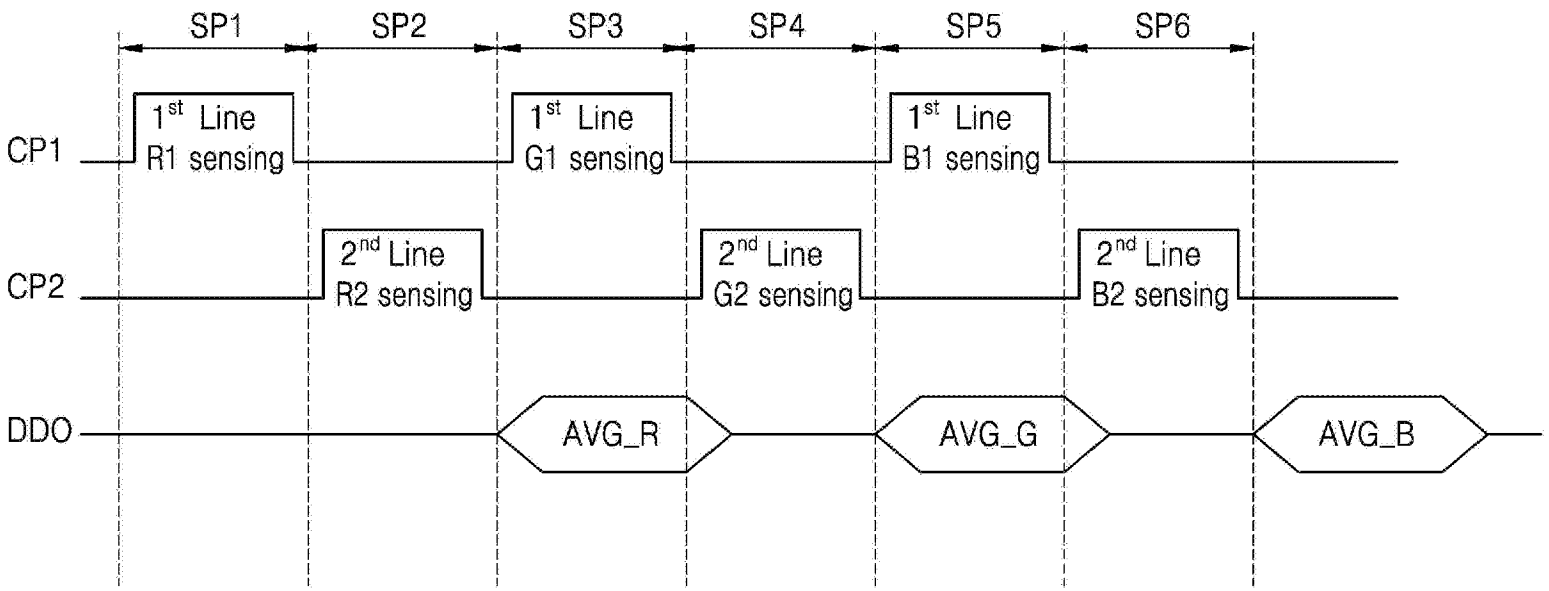
FIGS. 8A and 8B illustrate a method of measuring electrical characteristics of subpixels in FIG. 7.
Figure 8B:
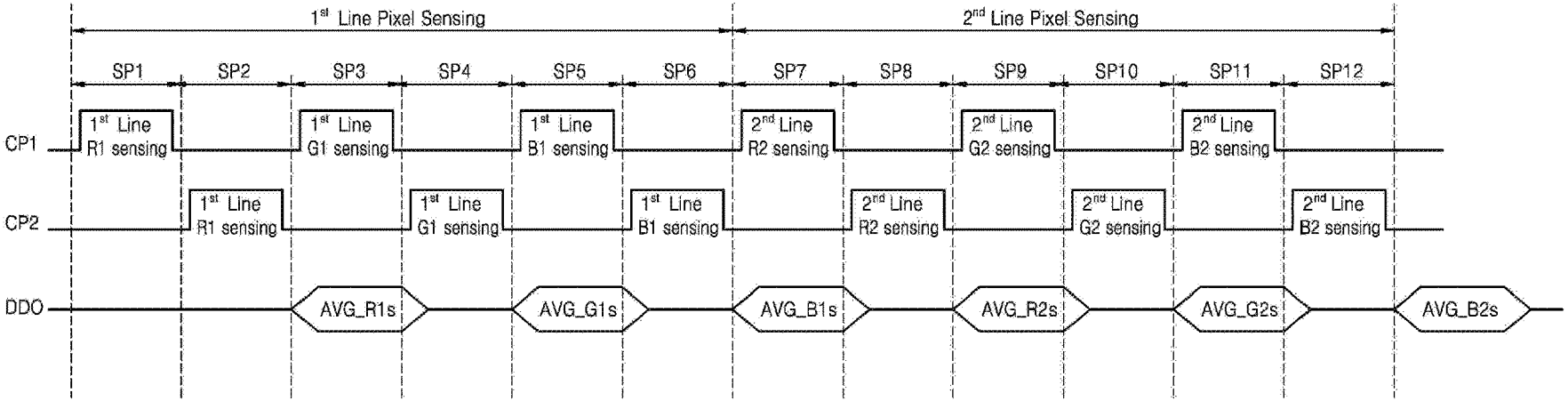

FIG. 7 illustrates an example of a pixel array structure of a display panel 20*a*, and FIGS. 8A and 8B illustrate a method of measuring the electrical characteristics of the subpixels SPX in FIG. 7.

Referring to FIG. 7, the display panel 20*a* may include a plurality of pixels PX, and each of the plurality of pixels PX may include first through third subpixels (SPXr, SPXg, and SPXb). For example, the first through third subpixels (SPXr, SPXg, and SPXb) may output red color light, green color light, and blue color light, respectively.

Referring to FIGS. 3A and 8A together, in one sensing period, the electrical characteristics of the subpixels SPX arranged in the same line (or row) and outputting the same color light may be measured, and in two sensing periods, the electrical characteristics of the subpixels SPX arranged in adjacent lines and outputting the same color light may be measured. For example, in the first sensing period SP1, the electrical characteristics of red subpixels R1 arranged in a first line may be measured. In the second sensing period SP2, the electrical characteristics of red subpixels R2 arranged in a second line adjacent to the first line may be measured In other words, in the first sensing period SP1, pixel signals of the red subpixels R1 arranged on the first line may be provided to the sensing block (120 in FIG. 3A) as the sensing signals through the first through $m^{th}$ sensing lines SL1 through SLm, and the sensing block 120 may perform the sampling operation on the received sensing signals, amplify the sampled sensing signals, and generate first red sensing values corresponding to the red subpixels R1 on the first line. In the second sensing period SP2, pixel signals of the red subpixels R2 arranged on the second line may be provided to the sensing block 120 as the sensing signals through the first through $m^{th}$ sensing lines SL1 through SLm, and the sensing block 120 may perform the sampling operation on the received sensing signals, amplify the sampled sensing signals and generate second red sensing values corresponding to the red subpixels R2 on the second line.

As described above, the channel switching block (123 in FIG. 3A) may perform the channel switching operation based on the first switching signal CP1 and the second switching signal CP2. In the first sensing period SP1, the first switching signal CP1 may be transitioned to the active level and in the second sensing period SP2, the second switching signal CP2 may be transitioned to the active level. Accordingly, a pixel voltage of the red subpixel R1 provided as the first sensing signal S1 via the first sensing line SL1 in the first sensing period SP1 and a pixel voltage of the red subpixel R2 provided as the first sensing signal S1 via the second sensing line SL2 in the second sensing period SP2 may be sampled by different sample-and-hold circuits from each other.

The sensing values corresponding to the sensing signals received via the same sensing line SL among first red sensing values and second red sensing values may be averaged, respectively. For example, the sensing values corresponding to the red pixels arranged in the same column and arranged in adjacent lines may be averaged. Accordingly, the reference red sensing values AVG_R may be generated, and the reference red sensing values AVG_R may be provided as the data driver output DDO of the data driver 100 to the timing controller (200 in FIG. 1) after the second sensing period SP2, for example, in a third sensing period SP3.

The electrical characteristics of green subpixels G1 arranged in the first line in the third sensing period SP3 may be measured to generate first green sensing values, and the electrical characteristics of green subpixels G2 arranged in the second line in a fourth sensing period SP4 may be measured to generate second green sensing values.

The sensing values corresponding to the sensing signals received via the same sensing line SL among the first green sensing values and the second green sensing values may be averaged, respectively. For example, the sensing values corresponding to the green pixels arranged in the same column and arranged in adjacent lines may be averaged. Accordingly, the reference green sensing values AVG_G may be generated, and the reference green sensing values AVG_G may be provided to the data driver 100 after the fourth sensing period SP4, for example, in a fifth sensing period SP5.

In a similar manner, blue subpixels B1 on the first line and blue subpixels B2 on the second line may be respectively sensed in the fifth sensing period SP5 and a sixth sensing period SP6, and accordingly, first blue sensing values and second blue sensing values may be generated. The sensing values corresponding to the sensing signals received via the same sensing line SL among the first and second blue sensing values may be averaged to generate blue sensing values AVG_B. The blue sensing values AVG_B may be output to the data driver 100 after the sixth sensing period SP6.

According to an example embodiment, sensing signals corresponding to pixel signals of subpixels being arrange in the same column and adjacent lines and corresponding to the same color light may be sampled through different sample-and-hold circuits in different sensing periods, and an average value of the sensing values generated based on the sensing signals may be generated as a reference sensing signal. The electrical characteristics of the adjacently arranged subpixels may be similar to each other. Accordingly, as described above, the sensing block 120 may generate the reference sensing value by averaging the sensing values corresponding to the adjacent subpixels.

On the other hand, referring to FIG. 8B, in two sensing periods, the electrical characteristics of subpixels arranged on the same line and outputting the same light may be measured. For example, the electrical characteristics of the red subpixels R1 in the first line may be measured in the first and second sensing periods SP1 and SP2. However, through the channel switching operation performed in response to the first switching signal CP1 and the second switching signal CP2, the pixel signals of the same red subpixels may be sampled by using different sample-and-hold circuits SH in the first and second sensing periods SP1 and SP2.

A plurality of reference red sensing values may be generated by averaging the sensing values corresponding to the same sensing signal, that is, the same red subpixel among the first red sensing values generated in the first sensing period SP1 and the second red sensing values generated in the second sensing period SP2. In a similar manner, in the third sensing period SP3 and the fourth sensing period SP4, the electrical characteristics of the green subpixels G1 of the first line may be measured, and the fifth sensing period SP5 and the sixth sensing period SP6, the electrical characteristics of the blue subpixels B1 of the first line may be measured. Accordingly, in the first through sixth sensing periods SP1 through SP6, the electrical characteristics of the pixels PX in the first line may measured, and thereafter, in a similar manner described above, in seventh through twelfth sensing periods SP7 through SP12, the electrical characteristics of the pixels PX in the second line may be measured.

Figure 9:
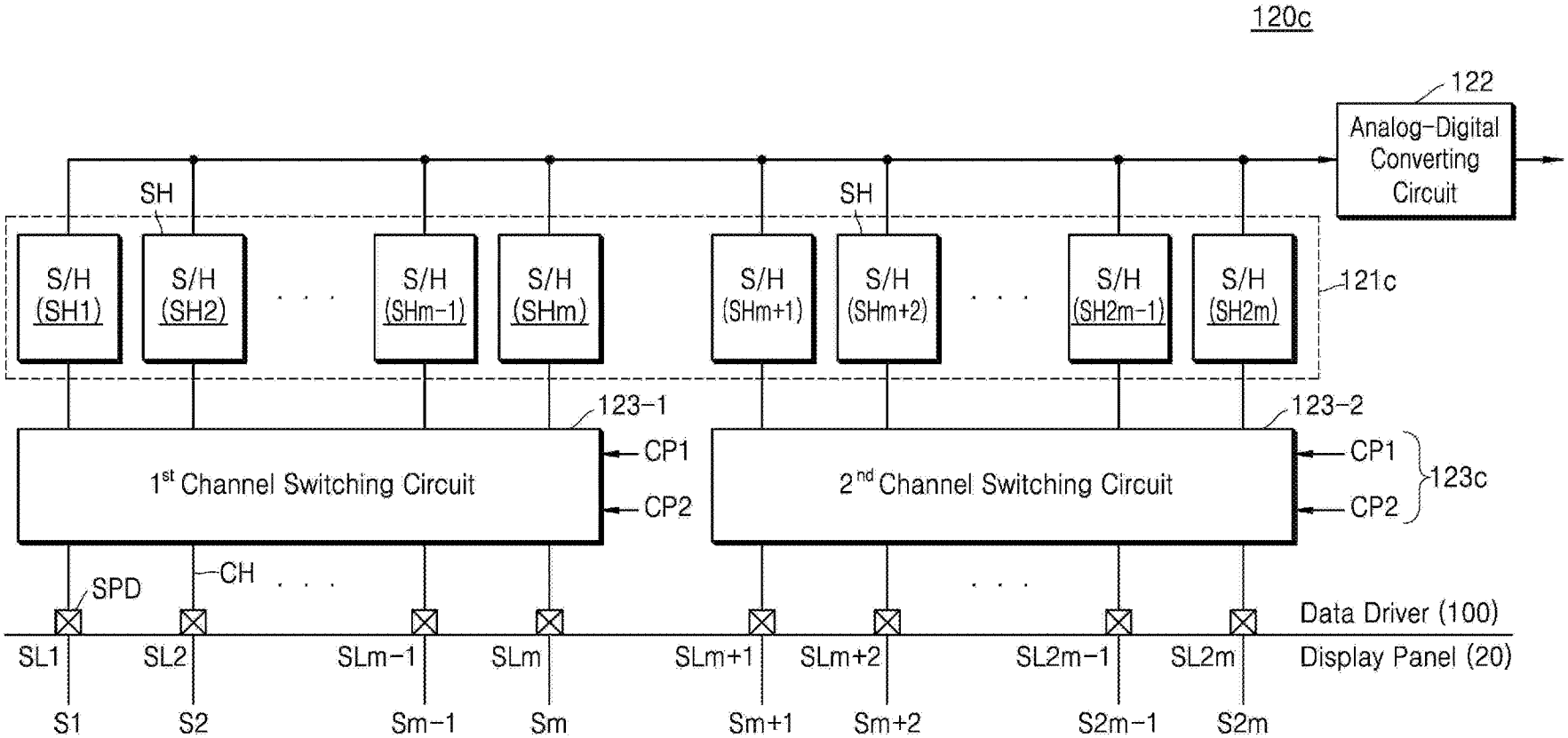
FIG. 9 is a circuit diagram of a sensing block according to an example embodiment of the disclosure.

FIG. 9 is a circuit diagram of a sensing block 120*c* according to an example embodiment of the disclosure.

Referring to FIG. 9, the sensing block 120*c* may include a sampling block 121*c*, an analog-to-digital converting circuit 122*c*, and a channel switching block 123*c*. The sampling block 121*c* may include a plurality of sample-and-hold circuits SH, for example, first through 2m sample-and-hold circuits SH1 through SH2*m*. The channel switching block 123*c* may include a plurality of channel switching circuits, for example, a first channel switching circuit 123-1 (or a first switching block) and a second channel switching circuit 123-2 (or a second switching block). In FIG. 9, the channel switching block 123*c* is illustrated as including two channel switching circuits. However, the embodiment is not limited thereto. The channel switching block 123*c* may include three or more channel switching circuits.

The first channel switching circuit 123-1 and the second channel switching circuit 123-2 may each perform the channel switching operation in response to the first switching signal CP1 and the second switching signal CP2.

The first channel switching circuit 123-1 may provide the first through $m^{th}$ sensing signals S1 through Sm received via the first through $m^{th}$ sensing lines SL1 through SLm to the first through $m^{th}$ sample-and-hold circuits SH1 through SHm, and in response to the first switching signal CP1 and the second switching signal CP2, may perform the channel switching operation in which channels of the first through $m^{th}$ sensing signals S1 through Sm are changed.

The second channel switching circuit 123-2 may provide the $(m+1)^{th}$ through $2m^{th}$ sensing signals Sm+1 through S2*m* received via the $(m+1)^{th}$ through $2m^{th}$ sensing lines SLm+1 through SL2*m* to the $(m+1)^{th}$ through $2m^{th}$ sample-and-hold circuits SHm+1 through SH2*m*, and in response to the first switching signal CP1 and the second switching signal CP2, may perform the channel switching operation in which channels of the $(m+1)^{th}$ through $2m^{th}$ sensing signals Sm+1 through S2*m* are changed.

By the channel switching operations of the first channel switching circuit 123-1 and the second channel switching circuit 123-2, in the first sensing period SP1, the first sensing signal S1 may be provided to the first sample-and-hold circuit SH1, and the $(m+1)^{th}$ sensing signal Sm+1 may be provided to the $(m+1)^{th}$ sample-and-hold circuit SHm+1; and in the second sensing period SP2, the first sensing signal S1 may be provided to the $m^{th}$ sample-and-hold circuit SHm, and the $(m+1)^{th}$ sensing signal Sm+1 may be provided to the $2m^{th}$ sample-and-hold circuit SH2*m*. The first through $2m^{th}$ sample-and-hold circuits SH1 through SH2*m* may sequentially output the sampled signals to the analog-to-digital converting circuit 122 in the first sensing period SP1 and the second sensing period SP2, respectively. Since the operation of the analog-to-digital converting circuit 122 and the operation process on the outputs of the analog-to-digital converting circuit 122 are the same as those descriptions with reference FIG. 3A, descriptions thereof are omitted.

Figure 10:
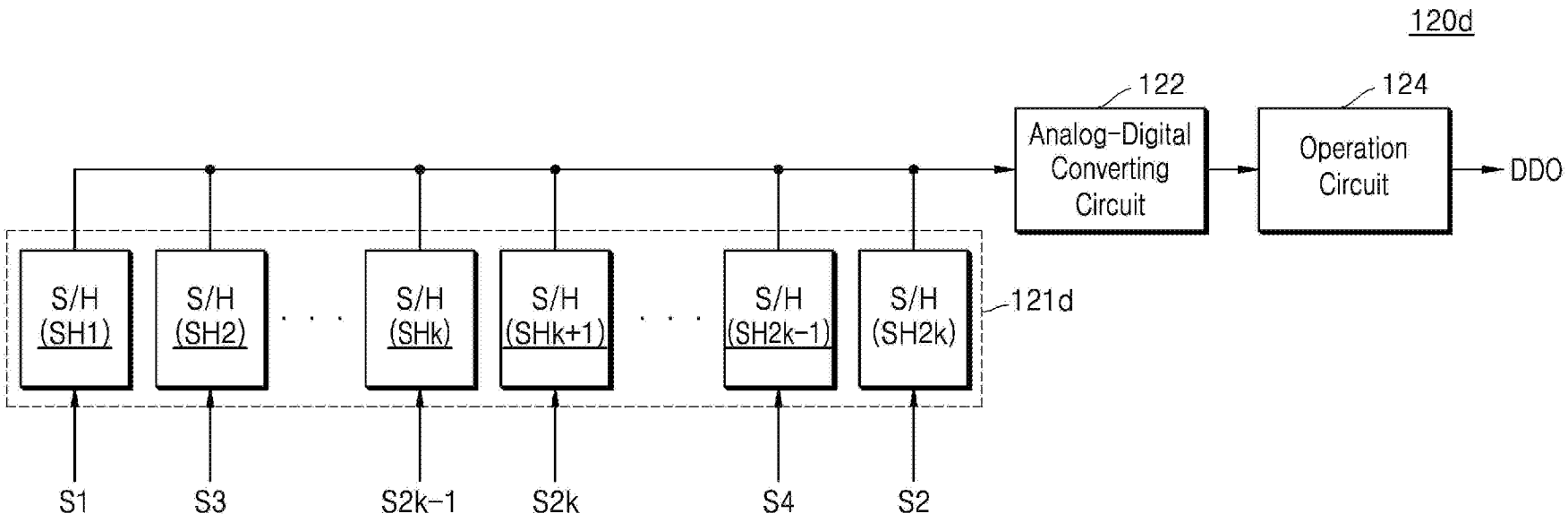
FIG. 10 is a block diagram of a sensing block according to an example embodiment of the disclosure.

FIG. 10 is a block diagram of a sensing block 120*d* according to an example embodiment of the disclosure.

Referring to FIG. 10, the sensing block 120*d* may include a sampling block 121*d*, the analog-to-digital converting circuit 122, and the operation circuit 124.

The sampling block 121*d* may include first through $(2k)^{th}$ sample-and-hold circuits SH1 through SH2*k* (where k is an integer of 2 or more). The first through the $(2k)^{th}$ sensing signals S1 through S2*k* may be received, and odd-numbered sensing signals among the first through the $(2k)^{th}$ sensing signals S1 through S2*k* may be provided to the first through $k^{th}$ sample-and-hold circuits SH1 through SHk, and even-numbered sensing signals among the first through the $(2k)^{th}$ sensing signals S1 through S2*k* may be provided to the $(k+1)^{th}$ through $(2k)^{th}$ sample-and-hold circuits SHk+1 through SH2*k*.

The first through $(2k)^{th}$ sample-and-hold circuits SH1 through SH2*k* may sequentially output the sampled signals to the analog-to-digital converting circuit 122, and the analog-to-digital converting circuit 122 may generate first through $(2k)^{th}$ sensing values by sequentially converting outputs of the first through $(2k)^{th}$ sample-and-hold circuits SH1 through SH2*k*. The first through $(2k)^{th}$ sensing values may include the first sensing values generated based on the odd-numbered sensing signals and the second sensing values generated based on the even-numbered sensing signals.

The operation circuit 124 may generate a reference sensing value by averaging the sensing values corresponding to the sensing signals received via adjacent sensing lines among the first sensing values and the second sensing values. For example, the operation circuit 124 may generate a first reference sensing value by averaging a sensing value corresponding to the first sensing signal Si and a sensing value corresponding to the second sensing signal S2. The first sensing signal Si and the second sensing signal S2 may be output from adjacent pixels PX having similar electrical characteristics, and may be sampled by the first and $(2k)^{th}$ sample-and-hold circuits SH1 and SH2*k* which are far apart from each other. Accordingly, by averaging the sensing values generated based on the first sensing signal S1 and the second sensing signal S2, the output variations of the first and $(2k)^{th}$ sample-and-hold circuits SH1 and SH2*k* may be canceled. The first reference sensing value may be used for compensating the subpixel data SPXD corresponding to two pixels PX from which the first sensing signal S1 and the second sensing signal S2 have been output.

Figure 11:
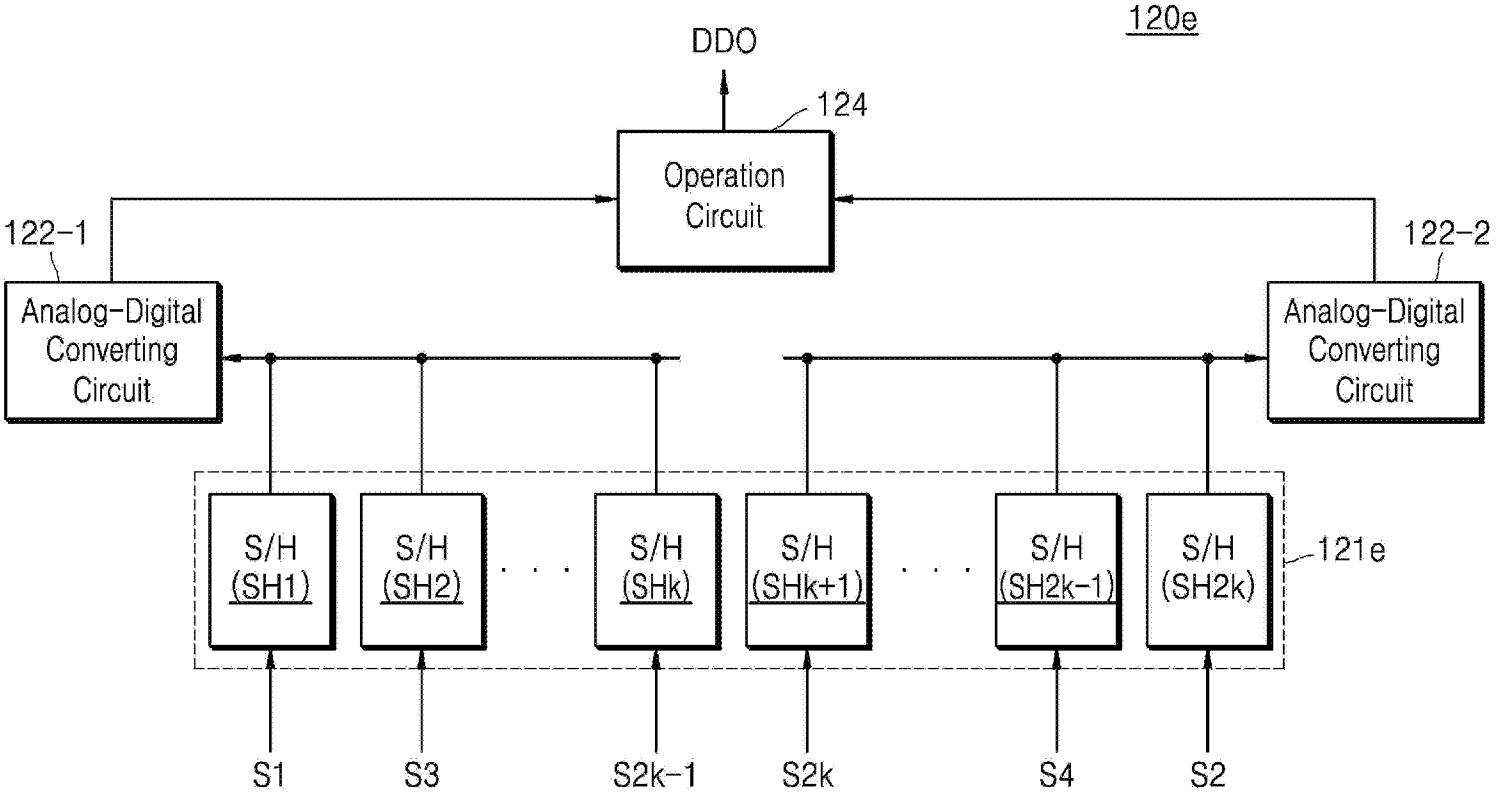
FIG. 11 is a block diagram of a sensing block according to an example embodiment of the disclosure.

FIG. 11 is a block diagram of a sensing block 120*e* according to an example embodiment of the disclosure.

Referring to FIG. 11, the sensing block 120*e* may include a sampling block 121*e*, a first analog-to-digital converting circuit 122-1, a second analog-to-digital converting circuit 122-2, and the operation circuit 124.

The first analog-to-digital converting circuit 122-1 may generate k sensing values corresponding to the odd-numbered sensing signals (S1, S3, . . . , S2*k*−1) by sequentially performing the analog-to-digital conversion on the first through $k^{th}$ sample-and-hold circuits SH1 through SHk, and the second analog-to-digital converting circuit 122-2 may generate k sensing values corresponding to the even-numbered sensing signals (S2, S4, . . . S2*k*) by sequentially performing the analog-to-digital conversion on the $(k+1)^{th}$ through $(2k)^{th}$ sample-and-hold circuits SHk+1 through SH2*k*. Alternatively, the first and second analog-to-digital converting circuits 122-1 and 122-2 may simultaneously perform the analog-to-digital converting operation, and accordingly, the sensing period may be reduced.

The operation circuit 124 may generate the reference sensing value by averaging the sensing value output from the first analog-to-digital converting circuit 122-1 and the sensing value output from the second analog-to-digital converting circuit 122-2. Accordingly, the channel deviations of the first through $(2k)^{th}$ sample-and-hold circuits SH1 through SH2*k* may be canceled, and in addition, the output deviations of the first analog-to-digital converting circuit 122-1 and the second analog-to-digital converting circuit 122-2 may be canceled.

Figure 12:
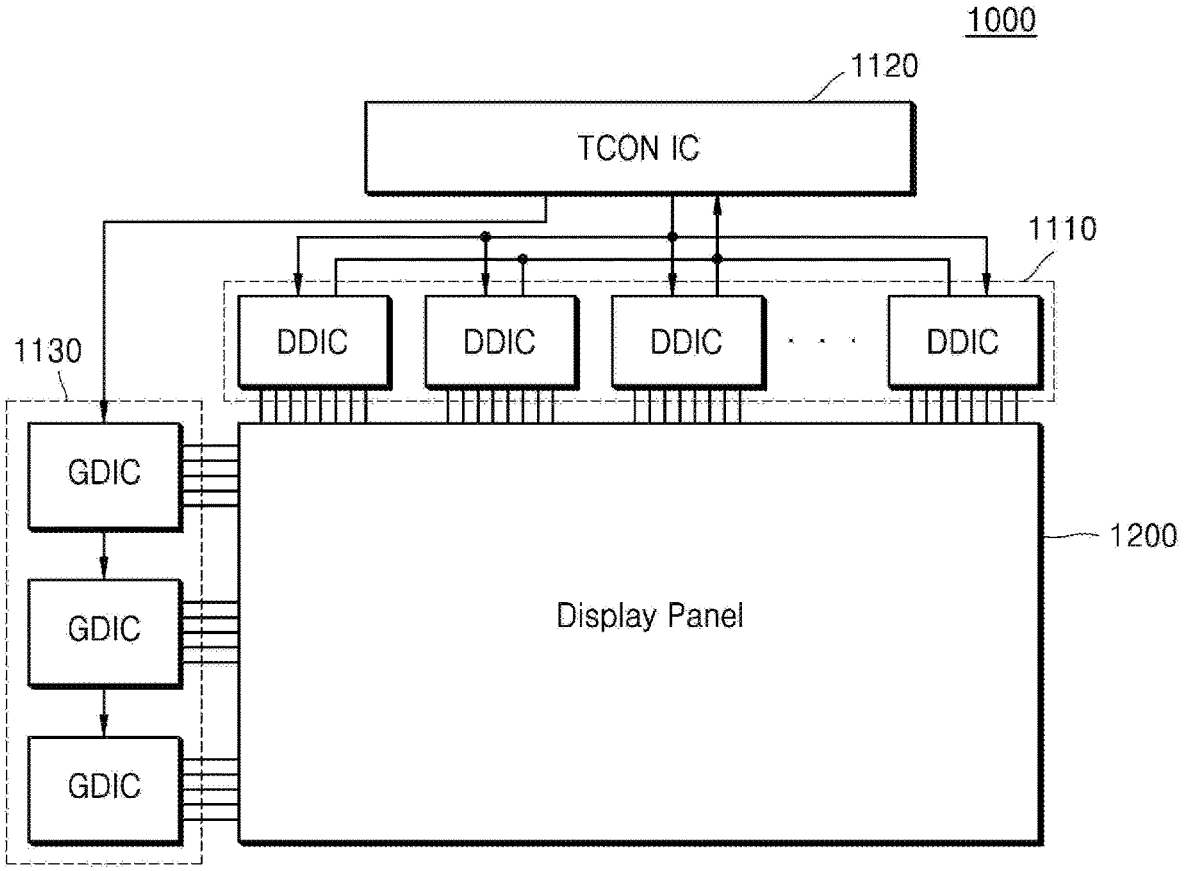
FIG. 12 illustrates an implementation example of a display device, according to an example embodiment of the disclosure.

FIG. 12 illustrates an implementation example of a display device 1000, according to an example embodiment of the disclosure. The display device 1000 of FIG. 12 may be a device including a display panel 1200 of a medium-large size, and may be applied to, for example, a television, a monitor, etc.

Referring to FIG. 12, the display device 1000 may include a data driver 1110, a timing controller 1120, a gate driver 1130, and a display panel 1200.

The timing controller 1120 may include one or more integrated circuits (IC) or modules. The timing controller 1120 may communicate with a plurality of data driving ICs DDIC and a plurality of gate driving ICs GDIC via set interfaces.

The timing controller 1120 may generate control signals for controlling driving timings of the plurality of data driving ICs DDIC and the plurality of gate driving ICs GDIC, and may provide the control signals to the plurality of data driving ICs DDIC and the driving IC GDIC.

The timing controller 1120 may divide the image data received from the outside, and provide a plurality of divided image data to the plurality of data driving ICs DDIC. In addition, the time controller 1120 may detect the electrical characteristics of the subpixels SPX based on the reference sensing values received from the data driver 1110, and may determine compensation values to be used for data compensation. The timing controller 1120 may perform the data compensation on the received image data.

The data driver 1110 may include the plurality of data driving ICs DDIC, and the plurality of data driving ICs DDIC may be mounted on a circuit film such as a tape carrier package (TCP), a chip on film (COF), and a flexible printed circuit (FPC). The data driver 1110 may be attached to the display panel 1200 by using a tape automatic bonding (TAB) manner, or mounted on a non-display area of the display panel 1200 by using a chip on glass (COG) manner.

At least one of the plurality of data driving ICs DDIC may include the sensing block 120 described with reference to FIG. 1. According to the above-described method in an example embodiment, the sensing block 120 may internally compensate the output deviation, that is, the channel deviation, of the plurality of sample-and-hold circuits SH. Thus, when the compensation is performed by the sensing block 120, compensation for the channel deviation by the timing controller 1120 may not be required, and accordingly, a compensation algorithm may be simplified and a load of the timing controller 1120 may be reduced.

The gate driver 1130 may include a plurality of gate driving ICs GDIC, and the plurality of gate driving ICs GDIC may be, while being mounted on a circuit film, attached to the display panel 1200 by using the TAB method, or mounted on the non-display area of the display panel 1200 by using the COG method. Alternatively, the gate driver 1130 may be formed directly on a bottom substrate of the display panel 1200 by using a gate-driver in panel (GIP) method. The gate driver 1130 may be formed on the non-display area outside the pixel array in which the subpixels SPX are formed in the display panel 1200, and may be formed by the same TFT process as the subpixels SPX.

Figure 13:
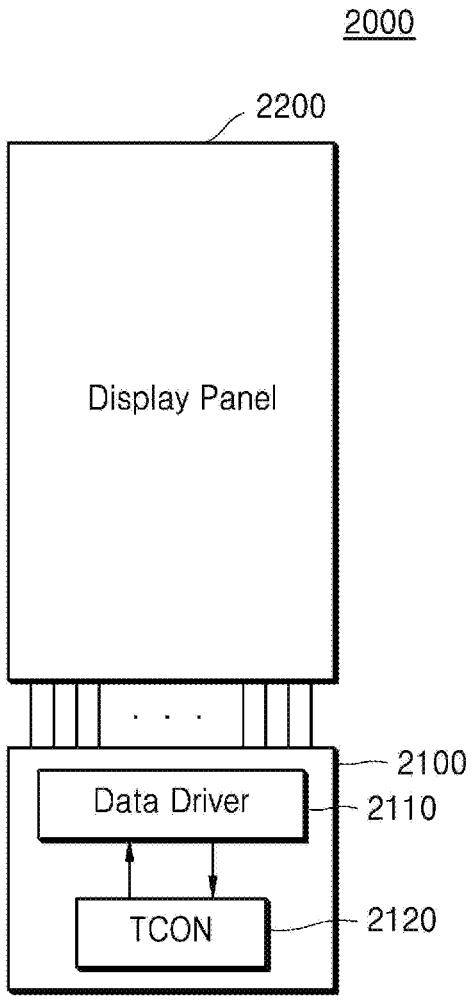
FIG. 13 illustrates an implementation example of a display device, according to an example embodiment of the disclosure.

FIG. 13 illustrates an implementation example of a display device 2000, according to an example embodiment of the disclosure. The display device 2000 of FIG. 13 may be a device including a display panel 2200 of a small size, and may be applied to a mobile device such as a smart phone, and a tablet PC. However, the disclosure is not limited thereto.

Referring to FIG. 13, the display device 2000 may include a display driving circuit 2100 and the display panel 2200. The display driving circuit 2100 may include one or more ICs and may be mounted on a circuit film such as TCP, COF, and FPC, and may be attached to the display panel 2200 by using the TAB method, or mounted on the non-display area of the display panel 2200 by using the COG method.

The display driving circuit 2100 may include a data driver 2110 and a timing controller (TCON) 2120, and may further include a gate driver. In an example embodiment, the gate driver may be mounted on the display panel 2200.

The data driver 100 described with reference to FIG. 1 may be applied as the data driver 2110. In the sensing mode, the data driver 2110 may measure the electrical characteristics of the subpixels SPX of the display panel 2200, and provide the electrical characteristics of the measured subpixels SPX to the timing controller 2120. The timing controller 2120 may compensate the image data based on the electrical characteristics of the detected subpixels SPX. The timing controller 2120 may provide the compensated image data to the data driver 2110, and the data driver 2110 may drive the display panel 2200 based on the compensated image data.

The data driver 2110 may include the plurality of sample-and-hold circuits SH which perform the sampling operation on the sensing signals received from the subpixels SPX, and may internally compensate for the output variations of the plurality of sample-and-hold circuits SH. Accordingly, the compensation algorithm for external compensation may be simplified, and the load of the timing controller 2120 performing the data compensation may be reduced.

At least one of the components, elements, modules or units described herein may be embodied as various numbers of hardware, software and/or firmware structures that execute respective functions described above, according to an example embodiment. Two or more of these components, elements or units may be combined into one single component, element or unit which performs all operations or functions of the combined two or more components, elements of units. Also, at least part of functions of at least one of these components, elements or units may be performed by another of these components, element or units.

While a few example embodiments have been described above, the scope of the disclosure is not limited thereto and various modifications and improvements made by those of ordinary skill in the art to concepts defined in the following claims should be understood to fall within the scope of the disclosure.

What is claimed is:

1. A data driver configured to drive a display panel, the display panel comprising a plurality of sensing lines and a plurality of subpixels connected to the plurality of sensing lines, the data driver comprising:

a plurality of sample-and-hold circuits configured to perform a sampling operation on a plurality of sensing signals respectively received via the plurality of sensing lines;

a switching block configured to provide the plurality of sensing signals to the plurality of sample-and-hold circuits, the switching block being further configured to, in a first sensing period, provide a first sensing signal among the plurality of sensing signals to a first sample-and-hold circuit among the plurality of sample-and-hold circuits, and in a second sensing period, provide the first sensing signal to a second sample-and-hold circuit not being adjacent to the first sample-and-hold circuit among the plurality of sample-and-hold circuits, wherein a third sample-and-hold circuit among the plurality of sample-and-hold circuits is disposed between the first sample-and-hold circuit and the second sample-and-hold circuit; and a converting circuit configured to generate a plurality of sensing values by amplifying and performing an analog-to-digital conversion on outputs of the plurality of sample-and-hold circuits.

2. The data driver of claim 1, wherein the switching block is further configured to:

in the first sensing period, provide the plurality of sensing signals to the plurality of sample-and-hold circuits in a first sequential order, and in the second sensing period, provide the plurality of sensing signals to the plurality of sample-and-hold circuits in a second sequential order opposite to the first sequential order.

3. The data driver of claim 1, wherein the switching block comprises a plurality of switching units respectively connected to the plurality of sample-and-hold circuits, and wherein each of the plurality of switching units is configured to, in the first sensing period, in response to a first switching signal, provide one sensing signal among the plurality of sensing signals to a corresponding sample-and-hold circuit, and in the second sensing period, in response to a second switching signal, provide another sensing signal among the plurality of sensing signals to the corresponding sample-and-hold circuit.

4. The data driver of claim 1, further comprising an operation circuit configured to generate a first reference sensing value to be used for compensating image data, by averaging a first sensing value generated in the first sensing period and a second sensing value generated in the second sensing period among the plurality of sensing values.

5. The data driver of claim 4, wherein the first sensing value corresponds to a first output signal output from the first sample-and-hold circuit in the first sensing period, and the second sensing value corresponds to a second output signal output from the second sample-and-hold circuit in the second sensing period.

6. The data driver of claim 4, wherein the first sensing value corresponds to the first sensing signal received via a first sensing line among the plurality of sensing lines in the first sensing period, and the second sensing value corresponds to the first sensing signal received via the first sensing line in the second sensing period.

7. The data driver of claim 4, wherein the first sensing value and the second sensing value correspond to two pixel signals respectively output from two adjacent subpixels connected to an identical sensing line among the plurality of sensing lines.

8. The data driver of claim 4, wherein the first sensing value and the second sensing value correspond to two pixel signals output from an identical subpixel of the display panel in the first sensing period and the second sensing period.

9. The data driver of claim 1, wherein the plurality of sample-and-hold circuits comprises 2m (m being an integer equal to or greater than 4) sample-and-hold circuits adjacently arranged to each other, and the switching block comprises:

a first switching block configured to, in the first sensing period, provide m first sensing signals among the plurality of sensing signals to m sample-and-hold circuits among the 2m sample-and-hold circuits in a first order, and, in the second sensing period, provide the m first sensing signals to the m sample-and-hold circuits in a second order opposite to the first order; and a second switching block configured to, in the first sensing period, provide m second sensing signals among the plurality of sensing signals to remaining m sample-and-hold circuits among the 2m sample-and-hold circuits in the first order, and, in the second sensing period, provide the m second sensing signals to the remaining m sample-and-hold circuits in the second order.

10. The data driver of claim 1, wherein the converting circuit comprises:

an amplifying circuit comprising a first capacitor connected to an input terminal and an output terminal of the amplifying circuit, the amplifying circuit being configured to amplify an output of each of the plurality of sample-and-hold circuits based on a ratio of a capacitance of the first capacitor and a capacitance of a second capacitor arranged in each of the plurality of sample-and-hold circuits; and an analog-to-digital converter (ADC) configured to perform an analog-to-digital conversion on an output of the amplifying circuit.

11. A display driving circuit, comprising:

a plurality of sample-and-hold circuits configured to receive a plurality of sensing signals respectively via a plurality of sensing lines of a display panel;

a switching block configured to, in a first sensing period, perform a first one-to-one connection of the plurality of sensing lines to the plurality of sample-and-hold circuits in a first order, and, in a second sensing period, perform a second one-to-one connection of the plurality of sensing lines to the plurality of sample-and-hold circuits in a second order opposite to the first order; and an analog-to-digital converting circuit configured to, in the first sensing period, generate a plurality of first sensing values based on respective outputs of the plurality of sample-and-hold circuits, and, in the second sensing period, generate a plurality of second sensing values based on the respective outputs of the plurality of sample-and-hold circuits.

12. The display driving circuit of claim 11, wherein the plurality of sample-and-hold circuits are arranged in a first direction, and the first order corresponds to an order among the plurality of sample-and-hold circuits in the first direction and the second order corresponds to an order among the plurality of sample-and-hold circuits in a second direction that is opposite to the first direction.

13. The display driving circuit of claim 11, further comprising a compensation circuit configured to compensate for output deviations among the plurality of sample-and-hold circuits.

14. The display driving circuit of claim 11, wherein the plurality of sample-and-hold circuits comprise m (m being an integer equal to or greater than 4) sample-and-hold circuits arranged in a first direction, the display driving circuit further comprising an operation circuit configured to generate a reference sensing value by averaging a sensing value corresponding to an output of a $(1+n)^{th}$ sample-and-hold circuit (n being an integer less than m) among the plurality of first sensing values and a sensing value corresponding to an output of an $(m-n)^{th}$ sample-and-hold circuit among the plurality of second sensing values.

15. The display driving circuit of claim 14, further comprising a compensation circuit configured to compensate image data to be displayed on the display panel based on the reference sensing value.

16. A data driver comprising:

a plurality of sample-and-hold circuits configured to perform a sampling operation on a plurality of sensing signals corresponding to a plurality of pixels respectively received via a plurality of sensing lines of a display panel;

at least one converting circuit configured to generate a plurality of sensing values by performing an analog-to-digital conversion on outputs of the plurality of sample-and-hold circuits; and an operation circuit configured to generate a reference sensing value to be used for compensating image data to be displayed on the display panel, by averaging at least two sensing values corresponding to at least two sample-and-hold circuits not being adjacent to each other, among the plurality of sample-and-hold circuits, wherein the at least two sample-and-hold circuits comprise a first sample-and-hold circuit and a second sample-and-hold circuit, a third sample-and-hold circuit among the plurality of sample-and-hold circuits being disposed between the first sample-and-hold circuit and the second sample-and-hold circuit.

17. The data driver of claim 16, further comprising a switching block configured to provide the plurality of sensing signals to the plurality of sample-and-hold circuits, wherein the switching block being further configured to, in a first sensing period, provide a first sensing signal among the plurality of sensing signals to the first sample-and-hold circuit among the plurality of sample-and-hold circuits, and, in a second sensing period, provide the first sensing signal to the second sample-and-hold circuit not being adjacent to the first sample-and-hold circuit among the plurality of sample-and-hold circuits.

18. The data driver of claim 16, wherein the plurality of sample-and-hold circuits comprise k first sample-and-hold circuits and k second sample-and-hold circuits sequentially arranged in a first direction, and wherein k odd-numbered sensing signals among the plurality of sensing signals are provided to the k first sample-and-hold circuits, and k even-numbered sensing signals are provided to the k second sample-and-hold circuits.

19. The data driver of claim 18, wherein the operation circuit is configured to average a first sensing value generated based on an odd-numbered sensing signal and a second sensing value generated based on an even-numbered sensing signal among the plurality of sensing values, and wherein the first sensing value and the second sensing value correspond to pixel signals of two adjacent pixels arranged on an identical column in the display panel.

20. The data driver of claim 18, wherein the at least one converting circuit comprises:

a first converting circuit configured to amplify and convert respective outputs of the k first sample-and-hold circuits; and a second converting circuit configured to amplify and convert respective outputs of the k second sample-and-hold circuits.

* * * * *